US005686906A

United States Patent [19]

Ono et al.

[11] Patent Number: 5,686,906

[45] Date of Patent: Nov. 11, 1997

[54] APPARATUS FOR MONITORING MOVING BODIES

[75] Inventors: Hidekazu Ono; Mikio Ide; Masayuki Yamamoto, all of Kobe, Japan

[73] Assignee: Mitsubishi Jukogyo Kabushiki Kaisha, Tokyo, Japan

[21] Appl. No.: 596,561

[22] Filed: Feb. 5, 1996

[30] Foreign Application Priority Data

Feb. 6, 1995 [JP] Japan ..... 7-018093

[51] Int. Cl.[6] ..... G08G 1/01

[52] U.S. Cl. ..... 340/928; 340/905; 340/933; 340/994

[58] Field of Search ..... 340/928, 933, 340/991, 904, 905, 994, 323 R

[56] References Cited

U.S. PATENT DOCUMENTS

| | | | |
|---|---|---|---|
| 3,602,881 | 8/1971 | Bayne | 340/928 |
| 3,697,941 | 10/1972 | Christ | 340/991 |
| 4,338,587 | 7/1982 | Chiappetti | 340/928 |
| 4,532,511 | 7/1985 | Lemelson | 340/933 |
| 5,289,183 | 2/1994 | Hassett et al. | 340/928 |
| 5,406,275 | 4/1995 | Hassett et al. | 340/928 |

FOREIGN PATENT DOCUMENTS

| | | |
|---|---|---|
| 0349413 | 1/1990 | European Pat. Off. . |
| 0401192 | 12/1990 | European Pat. Off. . |
| 0413948 | 2/1991 | European Pat. Off. . |
| 0416692A2 | 3/1991 | European Pat. Off. . |
| 0416692A3 | 3/1991 | European Pat. Off. . |
| 0495708 | 7/1992 | European Pat. Off. . |
| 2670404 | 6/1992 | France . |
| 1261025 | 2/1968 | Germany . |
| WO92/15978 | 9/1992 | WIPO . |

*Primary Examiner*—Jeffery Hofsass
*Assistant Examiner*—Davetta Woods
*Attorney, Agent, or Firm*—Jacobson, Price, Holman & Stern, PLLC

[57] ABSTRACT

A moving body monitoring apparatus for examining whether a moving body includes communication means or not or examining whether the moving body has particular information or not.

The apparatus includes a moving side communication element held in the moving body 1 capable of moving freely, fixed position side communication element 3 and 7 disposed in a fixed position and having a narrow particular range set as a communication area, the fixed position side communication element communicating with the moving side communication element held in the moving body passing through the area, moving body detecting element 2 and 4 for detecting the moving body entering into the communication area of the fixed position side communication element without contact with the moving body, and element 9 for deciding whether the moving body holds the moving side communication element or not on the basis of a communication result with the moving body by the fixed position side communication element and detection information of the moving body detecting element.

4 Claims, 25 Drawing Sheets

APPARATUS FOR MONITORING MOVING BODIES

BACKGROUND OF THE INVENTION

The present invention relates to a moving body monitoring apparatus for examining whether one or a plurality of moving bodies capable of moving freely right and left include communication means or not or whether the moving bodies include particular information or not.

The technique that radio communication apparatuses are mounted in moving bodies such as vehicles capable of moving freely right and left or are carried by men moving freely to communicate with the moving bodies or the men by means of the radio communication apparatuses attracts attention as the technique capable of being utilized widely in various fields. Further, it is considered that particular information is given to the radio communication apparatuses to utilize the apparatuses for management or monitoring.

For example, there is a multi-section toll road having routes jumbled complicatedly and interconnected with one another at various places or there is a case where different lines are interconnected with one another and can be utilized right through.

In this case, the above communication technique can be utilized in order to collect charges in accordance with utilization sections or utilization routes, to prevent illegal utilization of a passing ticket, to monitor utilization sections or utilization routes, to automate collection of charges or to transmit and receive information.

Further, the technique can be used to remotely examine whether a person other than an authorized persons enters into a building, a section or a site where it is necessary to keep a secret or remotely examine utilization situations of facilities and the like. In this manner, application of this technique spreads infinitely.

Further, the technique of examining whether the moving bodies or human beings have the communication means or not and the technique of deciding whether the moving bodies or human beings have the particular information or not have also come to the important technique.

Such techniques can be attained as follows. As the technique of monitoring whether the moving bodies have the communication means or not, the following technique is considered.

It shall be noted that the monitoring technique illustrated below is neither a prior art nor a known technique.

As shown in FIG. 26, a moving body 51 (for example, a vehicle) to be monitored runs on a road 50 having a plurality of lanes 50*a* and 50*b*. Antennas 52*a*, 52*b*, . . . for communicating with communication means of the moving body 1 are disposed in lanes 50*a*, 50*b*, . . . of the road 50, respectively. The antennas 52*a*, 52*b*, . . . are attached to a supporting structure 55 such as a support built on the road 50 and can communicate with the moving body 51 passing through the lane from above of the lanes 50*a*, 50*b*, . . . A moving body detecting device 53 for detecting the moving body 51 passing through the lane is disposed in each of the lanes 50*a*, 50*b*, . . .

The moving body detecting device 53 is a vehicle sensor of a type having a footboard mounted in the road, for example. The vehicle sensor of the footboard type is a vehicle sensing and discriminating sensor used widely in a toll gate of a toll road, for example, and includes a switch group or a plurality of resistor wires extending in a traverse direction of the road. The vehicle sensor can collect various information containing a moving direction and a speed of the moving body passing through the road on the basis of an opening and closing operation state of the switch group or variation in resistances of the resistor wires operated by a pressure of the moving body.

Limiting means 54 for limiting a traveling position of the moving body is provided between adjacent lanes in order to prevent the moving body 51 from entering from another lane. The limiting means 54 is a separation zone or a median strip, for example.

Passage of the moving body 51 can be detected by a detection output of the detecting device 53. Whether the moving body 51 has the communication means or not can be examined by whether communication with the moving body can be attained or not. This examination can be attained by examining whether communication by means of an antenna corresponding to a traveling position (traveling lane) of the moving body 51, of the antennas 52*a*, 52*b*, . . . is performed or not.

In this technique, correspondence of the position of the antennas 52*a*, 52*b*, . . . and the traveling position of the moving body is made by dividing the traveling position of the moving body by a partition for each communication area of the antenna so that the traveling position is coincident with the communication antenna exactly.

An example of a decision procedure as to whether the moving body 51 is equipped with the communication means or not in this technique is now described.

This decision procedure is also neither a prior art nor a known technique.

When traveling of the moving body 51 is detected, communication with the moving body 51 is attempted by the antenna 52*a*, 52*b*, . . . corresponding to the traveling position of the moving body 51.

When the communication is performed, it is decided that the moving body detected by the moving body detecting device 53 is equipped with the communication means. When the communication is not performed, it is decided that the moving body is not equipped with the communication means.

In this manner, it is possible to examine whether the passing moving body is equipped with the communication means.

It is possible to examine whether the passing moving body is equipped with the communication means or not by attempting communication with the communication means equipped in the moving body and making a decision on the basis of the result of the communication. However, in this case, it is necessary to provide a partition for limiting the traveling position of the moving body so as to separate another moving body from the communication area of the communication means of the moving body and to prevent communication with the moving body from being jumbled with that of other moving bodies which might otherwise prevent discrimination of one moving body from other moving bodies.

With such a configuration, the traveling position of the moving body is restricted upon communication due to the partition. Such a partition in a road is an obstacle and dangerous. Further, the road is narrowed by the partition and effective utilization of the road is prevented. It is necessary to control the traveling position before the partition so that the moving body does not collide with the partition.

The same problems occur in the case where tickets or commuter tickets are formed into IC cards provided with radio communication capabilities to form compact communication means which are carried by individual persons and are used for the examination of tickets in traffic facilities such as a railroad or the like, or in the case where passports, identification cards or employee cards are formed into IC cards provided with a radio communication capability in the same manner and the IC cards are examined remotely or utilized for management as to whether employees are present or not or management of persons coming in and out from a room, or in the case where communication means formed into cards provided with radio communication capabilities are carried by individual persons or goods in order to perform management of the goods and avoid theft in distribution industries, stores, factories or the like. The moving body detecting device must be installed in a road or a floor and be treaded upon by moving bodies in order to detect arrival of the moving bodies individually. Thus, when it is applied to human beings and goods, implementation thereof is difficult.

Since there are the various problems as described above, these problems are a bottle neck in the implementation thereof notwithstanding the effectiveness and the technique having wide application fields.

SUMMARY OF THE INVENTION

Accordingly, it is an object of the present invention to provide a moving body monitoring apparatus capable of monitoring moving bodies such as vehicles, human beings, goods and the like capable of moving from place to place freely and confirming information without installation of the partition or the moving body detecting device in the road or the floor.

In order to achieve the object, the moving body monitoring apparatus according to the first invention comprises moving side communication means held in a moving body capable of moving freely, fixed position side communication means disposed in a fixed position and having a narrow particular range set as a communication area, the communication means communicating with the moving side communication means held in the moving body passing through the area, moving body detecting means for detecting the moving body entering into the communication area of the fixed position side communication means without contact with the moving body, and means for deciding whether the moving body holds the moving side communication means or not on the basis of a communication result with the moving body by the fixed position side communication means and detection information of the moving body detecting means.

The moving body monitoring apparatus according to the second invention comprises moving side communication means held in a moving body capable of moving freely and for holding necessary particular information to be able to transmit the particular information, fixed position side communication means disposed in a fixed position and having a narrow particular range set as a communication area, the communication means communicating with the moving side communication means held in the moving body passing through the area, moving body detecting means for detecting the moving body entering into the communication area of the fixed position side communication means without contact with the moving body, and means for deciding whether the moving side communication means of the moving body holds the particular information or not on the basis of a communication result with the moving body by the fixed position side communication means and detection information of the moving body detecting means.

In the first invention, the moving body capable of moving freely is caused to hold the moving side communication means and when the moving body comes near or reaches a fixed position, the moving side communication means held in the moving body communicates with the fixed position side communication means installed in the fixed position and the moving body detecting means detects the moving body without contact with the moving body. The decision means decides whether the moving body holds the moving side communication means or not on the basis of the communication result with the moving body by the fixed position side communication means and the detection information of the moving body detecting means.

The fixed position side communication means having the narrow communication area and the moving side communication means held in the moving body communicate with each other to obtain the result and the information thereof is outputted. The moving body detecting means detects the moving body entering into the narrow communication area of the fixed position side communication means without contact with the moving body and outputs the information thereof. Accordingly, even when there is no partition for separating the moving body, another moving body can be separated. Since the partition is not required, the stability can be ensured and the movement space of the moving body can be utilized effectively without narrowing the space. Further, since the moving body can be detected without contact therewith, there is no limitation to objects to be detected. When there is a moving body entering into the narrow communication area of the fixed position side communication means, the moving body is detected. When there is the detection information thereof, whether the moving body holds the moving side communication means or not is decided on the basis of the communication result with the moving side communication means. Accordingly, the effects that whether the moving side communication means is present or not can be detected with high accuracy and the like are obtained.

In the second invention, the moving body capable of moving freely is caused to hold the moving side communication means holding the necessary particular information to be able to transmit the information and when the moving body comes near or reaches the fixed position, the fixed position side communication means installed in the fixed position and the moving side communication means held in the moving body communicate with each other. The moving body detecting means detects the moving body without contact therewith. The decision means decides whether the moving body holds the necessary particular information or not on the basis of the communication result with the moving body by the fixed position side communication means and the detection information of the moving body detecting means.

In this manner, the fixed position side communication means having the narrow communication area and the moving side communication means held in the moving body communicate with each other to obtain the result thereof and the information thereof is outputted. The moving body detecting means detects the moving body entering into the narrow communication area of the fixed position side communication means without contact with the moving body and outputs the information thereof. Accordingly, even when there is no partition for separating the moving body, another moving body can be separated. Since the partition is not required, the stability can be ensured and the movement space of the moving body can be utilized effectively without narrowing the space. Since the moving body can be detected without contact therewith, there is no limitation to objects to be detected. Further, when there is a moving body entering into the narrow communication area of the fixed position side communication means, the moving body is detected. When there is the detection information, whether the moving body holds the particular information or not is decided on the basis of the communication result with the moving side communication means. Accordingly, the effects that whether the particular information is present or not can be detected with high accuracy and the like are obtained.

The present invention comprises fixed position side communication means having the narrow communication area, moving body detecting means for detecting the moving body entering into the narrow communication area of the fixed position side communication means without contact with the moving body to output the information thereof, and means for deciding whether the moving body holds the communication means or not or deciding whether the moving body holds the particular information or not on the basis of the communication information of the fixed position side communication means and the detection information of the fixed position side communication means. The partition required in the conventional method for limiting the traveling position of the moving body therefore is not required. Accordingly, whether the moving body holds the communication means or not or whether the moving body holds the particular information is decided with high accuracy without limiting the traveling position of the moving body upon communication.

DESCRIPTION OF THE PREFERRED EMBODIMENTS

(First Embodiment)

Figure 1:
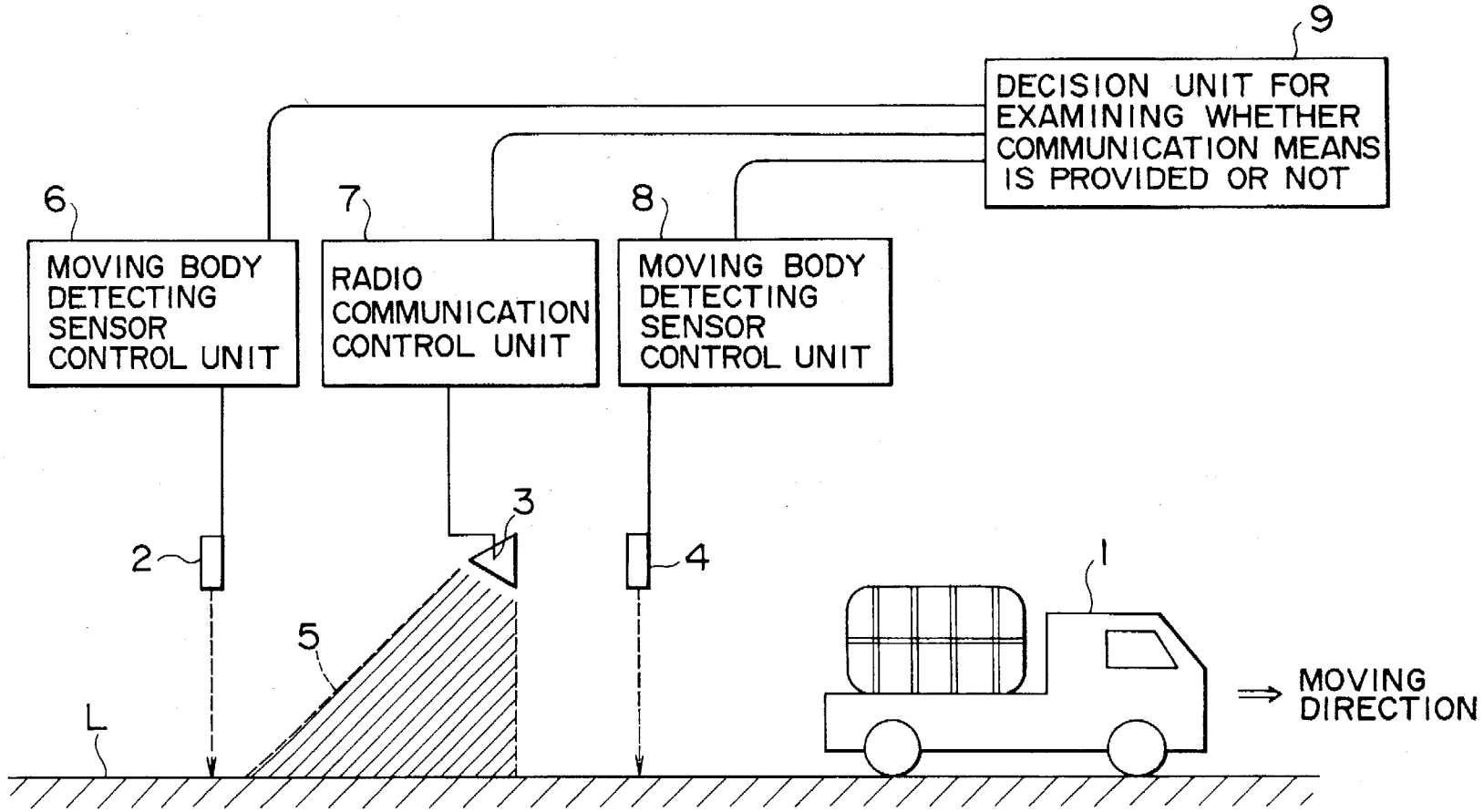
FIG. 1 is a schematic diagram illustrating a first embodiment of the present invention.

Embodiments according to the present invention are now described with reference to the drawings. FIG. 1 is a schematic diagram illustrating a first embodiment of the present invention.

In FIG. 1, reference mark L represents the surface of a road, and reference numeral 1 represents a moving body which moves on the road surface L and is a vehicle such as, for example, an automobile capable of moving freely in the forward and backward directions and turning to the right and left. The moving body 1 is equipped with a radio communication apparatus to be able to communicate with an external apparatus by radio. Numerals 2 and 4 denote moving body detecting sensors. As the moving body detecting sensor, for example, a CCD line sensor, an ultrasonic sensor, a laser scanner or the like are used. The moving body detecting sensor 2 is used to detect a leading end of the moving body 1 and the moving body detecting sensor 4 is used to detect a trailing end of the moving body 1. Further, the moving body detecting sensors 2 and 4 can produce positional information in the width direction of the moving body 1. The moving body detecting sensor 4 is disposed downstream of the road with a predetermined space from an installation point of the moving body detecting sensor 2.

Numerals 6 and 8 denote control units for the moving body detecting sensors. The control unit 6 has a clock function and uses a detection output obtained when the moving body detecting sensor 2 detects a leading end of the moving body 1 to calculate detection position information of the moving body 1 in the width direction of the road. Thus, the control unit 6 sends the calculated detection position information together with time information at the detection time of the moving body to a decision unit 9 for deciding whether communication means is provided or not. The control unit 8 also has a clock function and uses a detection output obtained when the moving body detecting sensor 4 detects a trailing end of the moving body 1 to calculate detection position information of the moving body 1 in the width direction of the road. The control unit 8 sends the calculated detection position information together with time information at the detection time of the moving body to the decision unit 9.

Numeral 3 denotes an antenna which is disposed between the moving body detecting sensors 2 and 4. The antenna 3 is connected to a radio communication control unit 7, which can communicate with a communication apparatus of the moving body 1 by means of the antenna 3 by radio. The radio communication control unit 7 sends information obtained by communication together with an ID information (identification information) of the antenna 3 used for communication to the decision unit 9.

The decision unit 9 decides whether the moving body 1 is equipped with the communication apparatus or not on the basis of the information (the detection position information of the moving body 1 and the time information at the detection time of the moving body) obtained from the sensor control units 6 and 8 and the information obtained from the radio communication control unit 7 and outputs the result thereof.

The decision unit 9 selects detection information and communication information estimated to be related to the same moving body from the detection record obtained from the sensor control units 6 and 8 constituting moving body detecting means and the communication record obtained from the radio communication control unit 7 constituting communication means and examines whether the moving body exists within a communicable range or not at the communication time with reference to the information including the detection position and the detection time of the moving body and the communicable range and the communication time with the moving body to thereby decide whether the vehicle detected by the moving body detecting means has made communication or not.

The decision unit 9 decides whether the moving body has made communication or not on the basis of the communication result between the moving bodies and the detection result of the moving body detecting means by using a method described later and specifies which moving body has made communication when a plurality of moving bodies exist simultaneously.

Operation of the apparatus is now described.

The radio communication apparatus mounted in the moving body 1 is disposed at the center position in the width direction of the moving body 1 and behind the front end of the moving body 1. When the moving body 1 travels on the road and comes near or reaches the moving body detecting sensor 2, the moving body detecting sensor 2 detects the moving body 1 and supplies the detection output to the sensor control unit 6. Further, when the moving body 1 comes near or reaches the moving body detecting sensor 4, the sensor 4 detects the moving body 1 and supplies the output to the sensor control unit 8.

The sensor control unit 6 obtains the time information (arrival time) that the front portion of the moving body 1 comes near or reaches the moving body detecting sensor 2 and the position information of the front portion on the basis of the detection information supplied thereto and sends the information to the decision unit 9 as a moving body detection telegraphic message. The sensor control unit 8 obtains the time information (arrival time) that the rear portion of the moving body 1 comes near or reaches the moving body detecting sensor 4 and the position information of the rear portion on the basis of the detection information supplied thereto and sends the information to the decision unit 9 as a moving body detection telegraphic message.

The antenna 3 transmits and receives electric waves under control of the radio communication control unit 7 to communicate with the moving body 1. The radio communication control unit 7 sends the communication information together with the ID information of the antenna 3 used for the communication to the decision unit 9.

The antenna 3 is disposed above the road surface L, that is, above the road on which the moving body 1 travels and at least one or two or more antennas are disposed side by side in the width direction of the road surface (in the width direction of the lane of the road). The antenna 3 used herein has a predetermined communication area in the width direction of the road surface, that is, in the width direction of the lane of the road. When a plurality of antennas 3 are provided, the communication areas of the antennas may be overlapped with each other.

Figure 2:
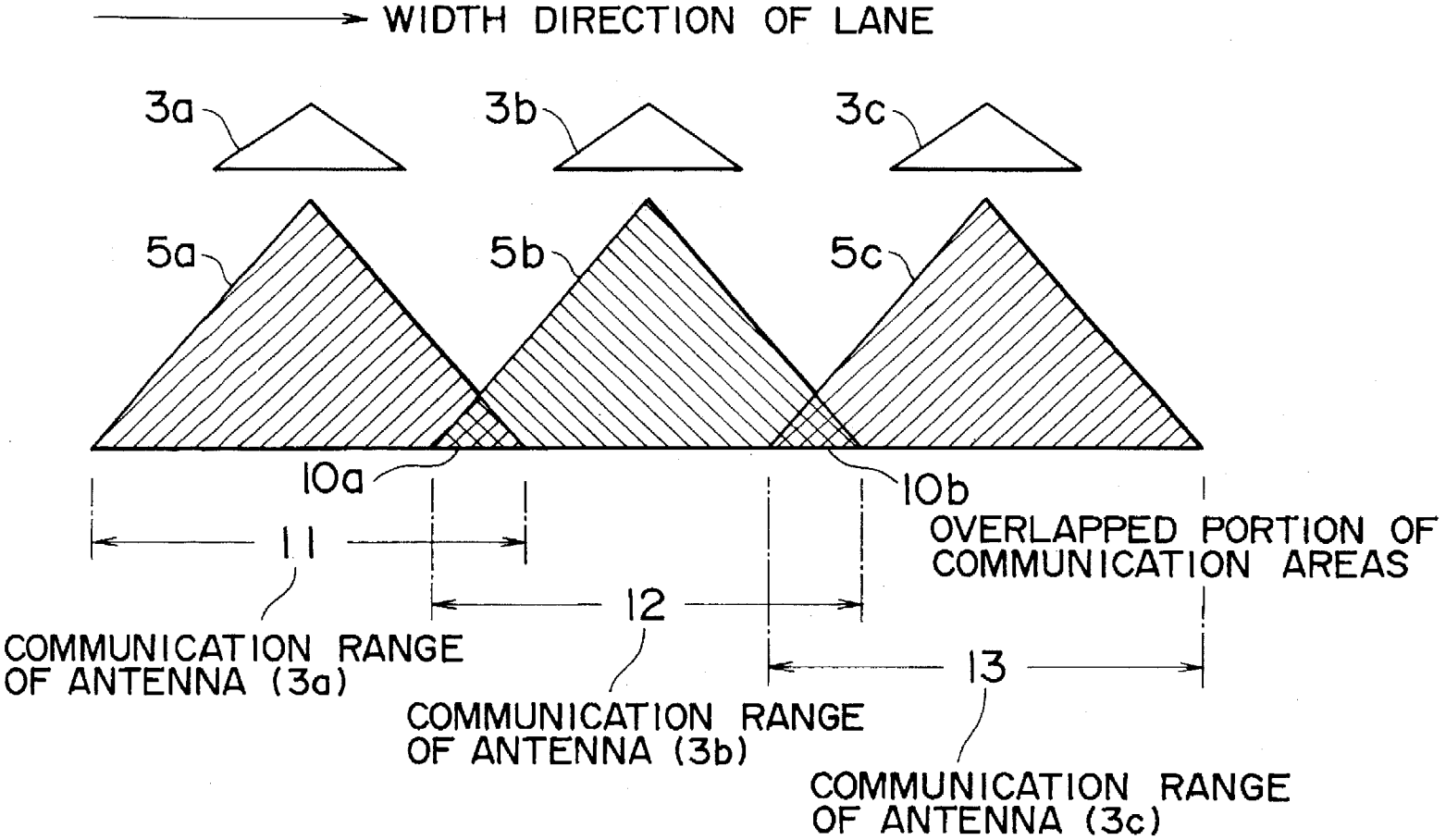
FIG. 2 is a diagram illustrating communication antennas and communication ranges thereof in the first embodiment of the present invention.

As an example thereof, FIG. 2 shows the case where three antennas 3*a* to 3*c* are disposed in the width direction of the lane in order. In FIG. 2, communication areas 5*a* to 5*c* of the antennas 3*a* to 3*c* are partially overlapped with each other. In FIG. 2, numeral 11 represents a communication range of the antenna 3*a* which is an area covered by the communication area 5*a*, numeral 12 represents a communication range of the antenna 3*b* which is an area covered by the communication area 5*b*, numeral 13 represents a communication range of the antenna 3*c* which is an area covered by the communication area 5*c*, and numerals 10*a* and 10*b* represent areas of overlapped portions of the communication areas.

These antennas 3 are connected to the radio communication control unit 7 to communicate with the moving body 1. The radio communication control unit 7 sends the communication record with the moving body 1 through a communication route to the decision unit 9 as a radio communication telegraphic message.

Figure 3:
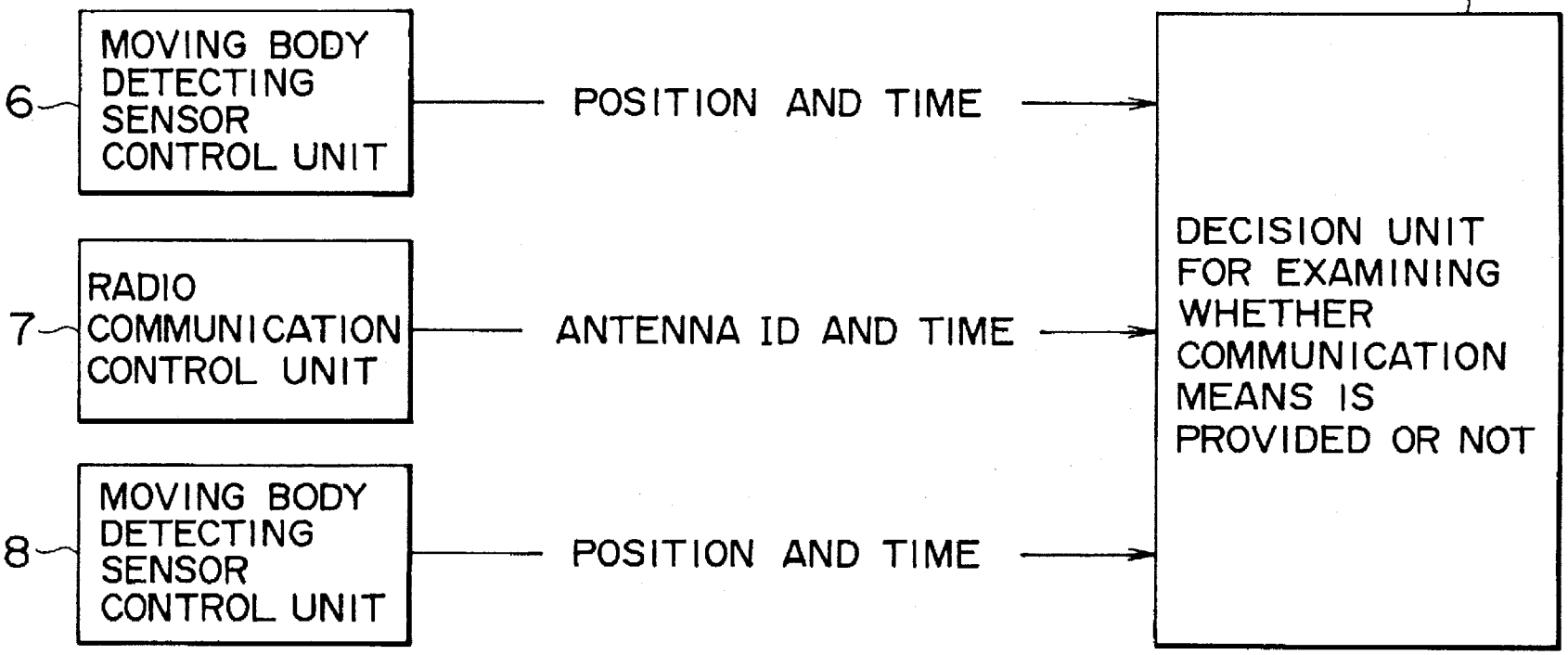
FIG. 3 is a diagram illustrating received information of a decision unit for deciding whether communication is present or not in the first embodiment of the present invention.
Figure 4A:
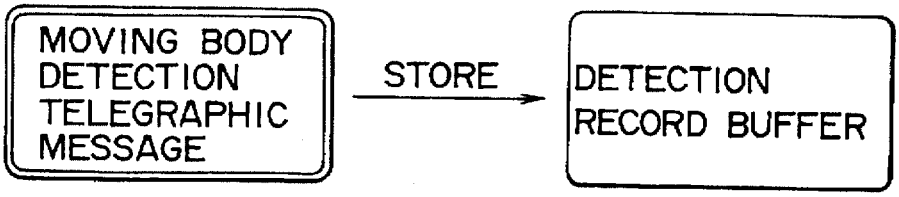
FIGS. 4(*a*)–4(*e*) are diagrams illustrating processing of information in the decision unit for deciding whether communication is present or not in the first embodiment of the present invention.
Figure 4B:
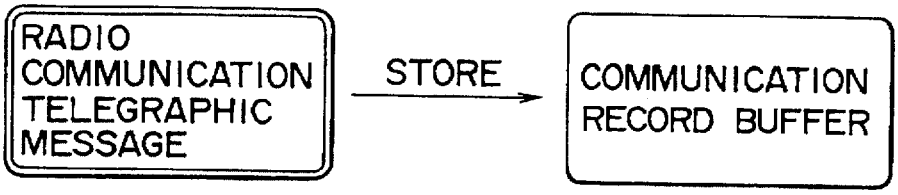
Figure 4C:
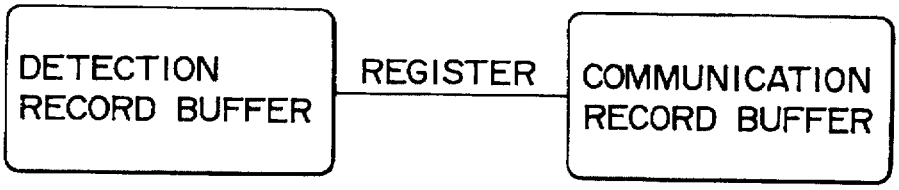
Figure 4D:
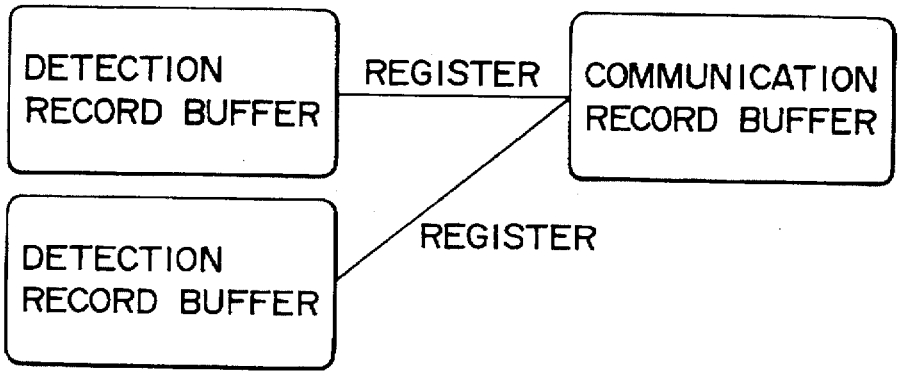
Figure 4E:
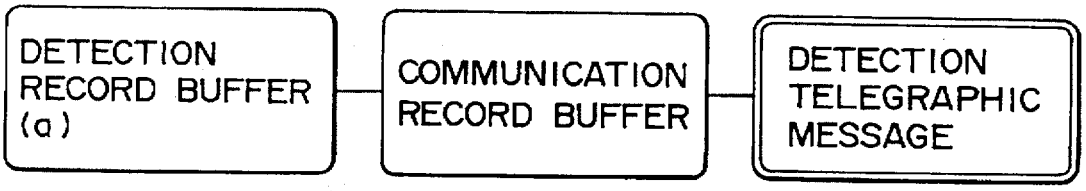
Figure 5A:
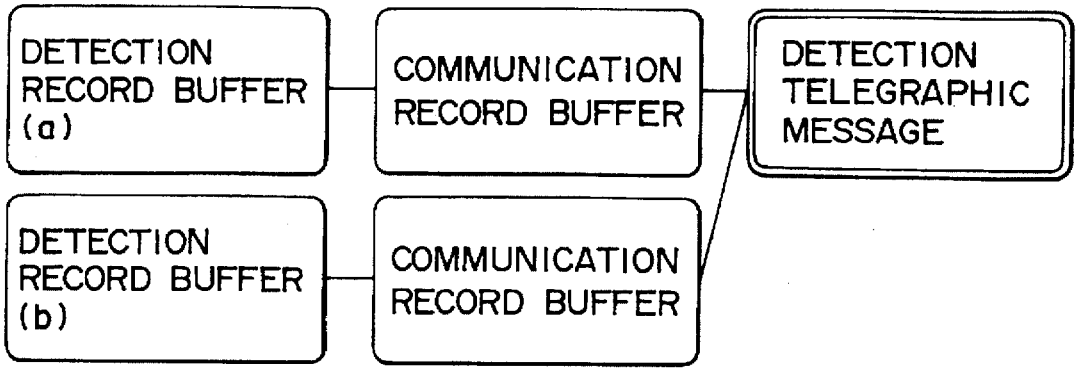
FIGS. 5(*a*)–5(*d*) are diagrams illustrating processing of information in the decision unit for deciding whether communication is present or not in the first embodiment of the present invention.
Figure 5B:
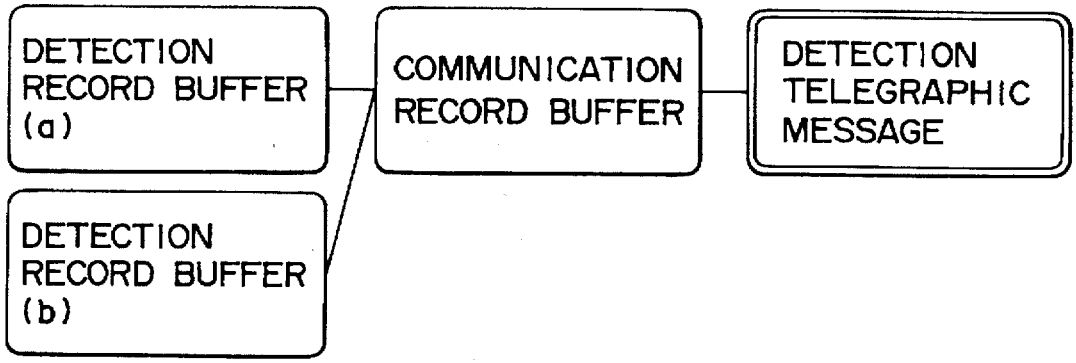
Figure 5C:
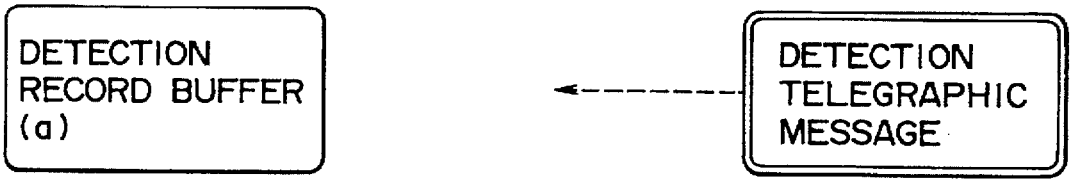
Figure 5D:
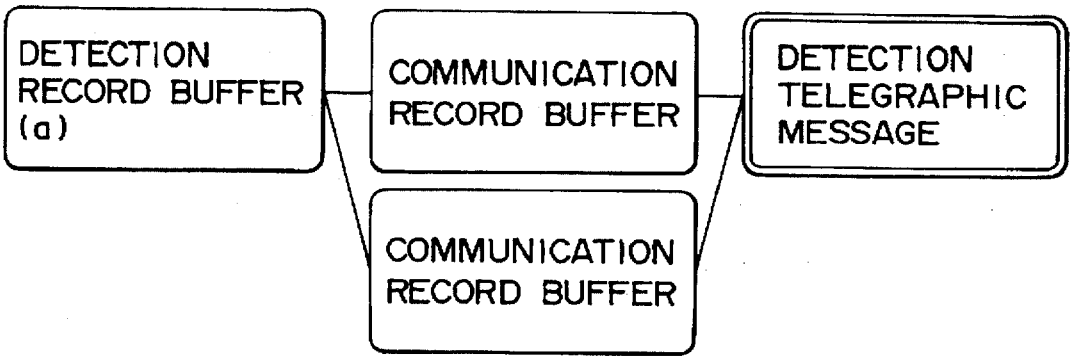

FIG. 3 shows primary information which is sent from the sensor control units 6 and 8 and the radio communication control unit 7 to the decision unit 9.

As shown in FIG. 3, the information sent from the sensor control units 6 and 8 to the decision unit 9 includes the detection position information of the moving body 1 in the width direction of the lane and the detection time information. Further, the information sent from the radio communication control unit 7 to the decision unit 9 includes the identification number (ID of the antenna) of the antenna 3 or (3*a* or 3*b* or 3*c*) used for communication with the moving body 1.

The antenna communicating with the moving body 1 is detected on the basis of the identification number of the antenna.

The decision unit 9 which has received such information performs the following process to decide whether the moving body is equipped with the communication apparatus or not. That is, the decision unit 9 receives a telegraphic message of transmission information from the sensor control unit 6, the radio communication unit 7 and the sensor control unit 8 in order of the units 6, 7 and 8 in response to movement of one moving body 1. Thus, the decision unit 9 performs the following process.

[1] The decision unit 9 receives the moving body detection telegraphic message from the sensor control unit 6 and then stores the contents of the message in a detection recording and preserving buffer formed in a memory area included in the decision unit (FIG. 4(*a*)).

[2] When the decision unit 9 receives the radio communication telegraphic message from the radio communication control unit 7, the decision unit 9 forms a communication recording buffer for preserving the contents of the message in the memory area or the buffer area included in the decision unit 9 and stores the contents of the received telegraphic message in the memory area or the buffer area (FIG. 4(*b*)).

[3] The decision unit 9 then searches information satisfying the following condition from detection recording information (moving body detection telegraphic message) stored in the detection recording and preserving buffer and registers or records contents of the searched detection recording buffer or a position of the buffer in the communication recording buffer in which the radio communication telegraphic message is stored to thereby form the correspondence therebetween (FIG. 4(*c*)).

[Condition 1: record including the detection position in the width direction of the moving body 1 within the communication range of the antenna specified by the antenna ID stored in the telegraphic message (radio communication telegraphic message) received from the radio communication control unit 7]

The communication area of the antenna is within the section between the moving body detecting sensors 2 and 4 and is positioned from just after the detection position of the moving body detecting sensor 2 (downstream direction of the road, that is, just forward in the traveling direction of the moving body). Accordingly, the detection position can correspond to the communication area and a corresponding detection record can be found out from the communication record.

[4] When a plurality of detection records (moving body detection telegraphic messages) can correspond to one communication record (radio communication telegraphic message) simultaneously, all of the moving body detection records (moving body detection telegraphic messages) are treated as moving body detection telegraphic messages for the same moving body and are registered or recorded in the communication record buffer to be able to correspond to the corresponding radio communication telegraphic messages (FIG. 4(*d*)).

[5] After a telegraphic message (moving body detection telegraphic message) has been received from the sensor control unit 8 for detection of the trailing end of the moving body, the number of communication records satisfying the following condition is examined.

[Condition 2: record including a detection position in the width direction of the moving body 1 recorded in the telegraphic message (moving body detection telegraphic message) received from the moving body detecting sensor 4 for detecting the trailing end of the moving body 1 within the communication range of the antenna]

FIG. 4(*e*) shows an example of a registered state of the detection record and the communication record after the moving body detection telegraphic message from the sensor control unit 8 has been received.

The moving body detecting sensor 4 detects the trailing end of the moving body 1. When the moving body 1 is equipped with a normal radio communication apparatus, communication of the radio communication control unit 7 and the moving body 1 has been already completed at the time that the trailing end of the moving body 1 is detected by the moving body detecting sensor 4. Accordingly, communication capable of being performed between the moving body 1 and the radio communication control unit until the moving body 1 passes through the radio communication control unit has been all completed and the number of communication records satisfying the above condition is examined to thereby determine the number of communication records performed between the moving body 1 and the radio communication control unit.

[6] The number of moving body detection records (moving body detection telegraphic messages) registered in the communication records (radio communication telegraphic messages) satisfying the condition 2 of the item [5] is examined. When the same moving body detection records (the same moving body detection telegraphic messages) are registered in a plurality of communication records (a plurality of radio communication telegraphic messages) in the overlapped manner, the number of moving body detection records is regarded as one.

[7] The number of detection records (number of moving body detection telegraphic messages) examined in the item [5] is compared with the number of communication records (number of moving body detection telegraphic messages) examined in the item [6].

As the result of comparison, when the number of moving body detection records is equal to the number of communication records as shown in FIG. 5(*a*), it is decided that the moving body 1 detected by the moving body detecting sensor 4 is equipped with the communication apparatus.

For example, as shown in FIG. 5(*b*), when the number of the moving body detection records is larger than the number of communication records, it is decided that there is a possibility that the moving body 1 detected by the sensor 4 is not equipped with the communication apparatus. The fact that the number of moving body detection records is larger than the number of communication records means that another moving body exists. In this case, since there is a possibility that another moving body has been detected, there is a possibility that the monitored moving body is not equipped with the communication apparatus. Accordingly, it can be decided that there is a possibility that the monitored moving body is not equipped with the communication apparatus.

Further, as shown in FIG. 5(*c*), when there is a moving body detection record, but there is no communication record, it can be decided that the moving body 1 is not equipped with the communication apparatus.

Furthermore, as shown in FIG. 5(*b*), when the number of moving body detection records is smaller than the number of communication records, it is decided that the moving body 1 is equipped with a plurality of communication means (communication apparatuses).

The system has the particular detection area and includes detection means for detecting the moving body passing through the detection area, communication means for communicating with the moving body passing through the detection area, and means for deciding whether the moving body is equipped with the communication apparatus or not on the basis of the number of detection information and communication information obtained from the detection means and the communication means. Thus, the system detects the moving body passing through the detection area by the detection means and communicates with the moving body passing through the detection area by the communication means. Further, the system compares the number of detection information obtained from the detection means with the number of communication information obtained from the communication means and can decide whether the moving body is equipped with the communication apparatus or not on the basis of the comparison result.

Further, by adding to the apparatus of the first embodiment shown in FIG. 1, imaging means capable of taking an image of a moving body having no communication apparatus or possibly having no communication apparatus when the moving body is detected, the moving body having no communication apparatus or possibly having no communication apparatus is specified and an image thereof can be recorded by the imaging means selectively. Further, by changing conditions, the moving body having the communication apparatus or possibly having the communication apparatus is specified and an image thereof can be recorded selectively.

Figure 6:
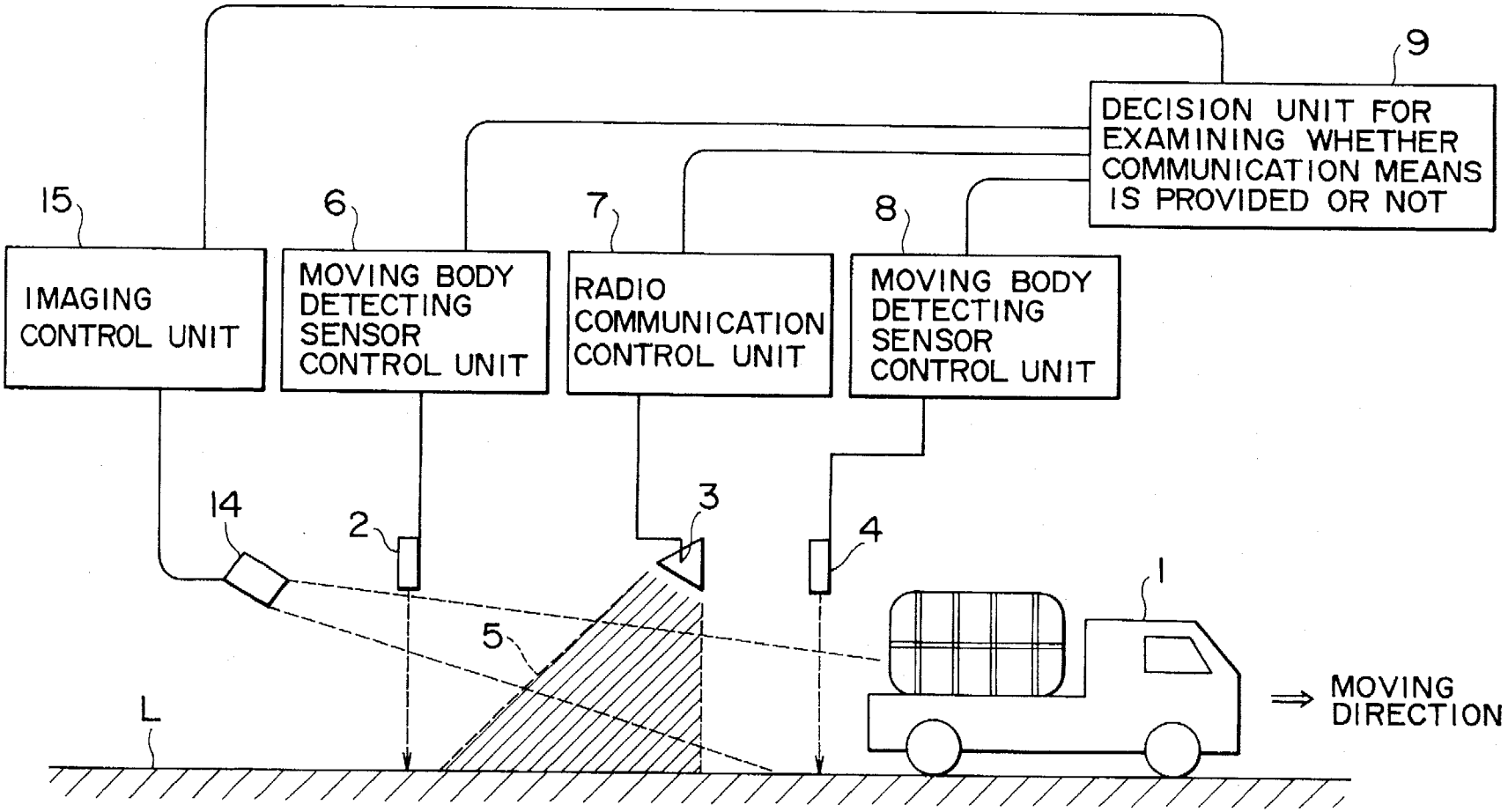
FIG. 6 is a schematic diagram illustrating a configuration including an imaging unit 14 disposed to be able to record a moving body passing through a detection position of a moving body detecting sensor 4 for detecting a trailing end of the moving body in an imaging area and an imaging control unit 15 operated in accordance with a decision result of a decision unit 9 for deciding whether communication means is present or not and controlling the imaging unit 14 in addition to the configuration of the apparatus of the first embodiment.

FIG. 6 illustrates a configuration example in the case where an imaging unit and a control unit of the imaging unit are added. The system of FIG. 6 includes an imaging unit 14 for detecting a trailing end of the moving body and an imaging control unit 15 operated in response to a decision result of the decision unit 9 to control the imaging unit 14 in addition to the configuration of the first embodiment shown in FIG. 1. The imaging unit 14 is set so that the moving body passing through the detection position of the moving body detecting sensor 4 falls within an imaging area.

In this configuration example, the moving body having no communication apparatus or possibly having no communication apparatus is imaged by the imaging unit 14 from the rear side of the moving body. When the decision unit 9 decides that the moving body 1 is not equipped with the communication apparatus or is not possibly equipped with the communication unit, an imaging trigger is sent to the imaging control unit 15 from the decision unit 9. The imaging control unit 15 can controls the imaging unit 14 to take an image of the moving body. The imaging unit 14 can utilize, for example, a CCD camera (camera using a solid imaging element), a television camera, a still camera or the like.

In this example, the imaging unit 14 is disposed to view the downstream side from the upstream side of the road so that the imaging unit 14 takes an image of the moving body 1 from the rear side of the moving body 1. However, there is a case where an image of the moving body 1 is taken from the front side thereof. In this case, the imaging unit may be disposed ahead in the traveling direction of the moving body 1 to be directed to the moving body.

In the foregoing description, communication with the moving body is made only in one particular area and decision as to whether the moving body is equipped with the communication apparatus or not is made on the basis of the communication record and the moving body detection information in the particular area. In this case, when another moving body exists near the moving body to be monitored, there is a tendency to decide that there is a possibility that the monitored moving body is not equipped with the communication apparatus. However, since there is a possibility that the moving body is equipped with the communication apparatus, it is desirable that decision as to whether the moving body is equipped with the communication apparatus or not is made with higher accuracy.

An example thereof is now described as a second embodiment.

(Second Embodiment)

Figure 7:
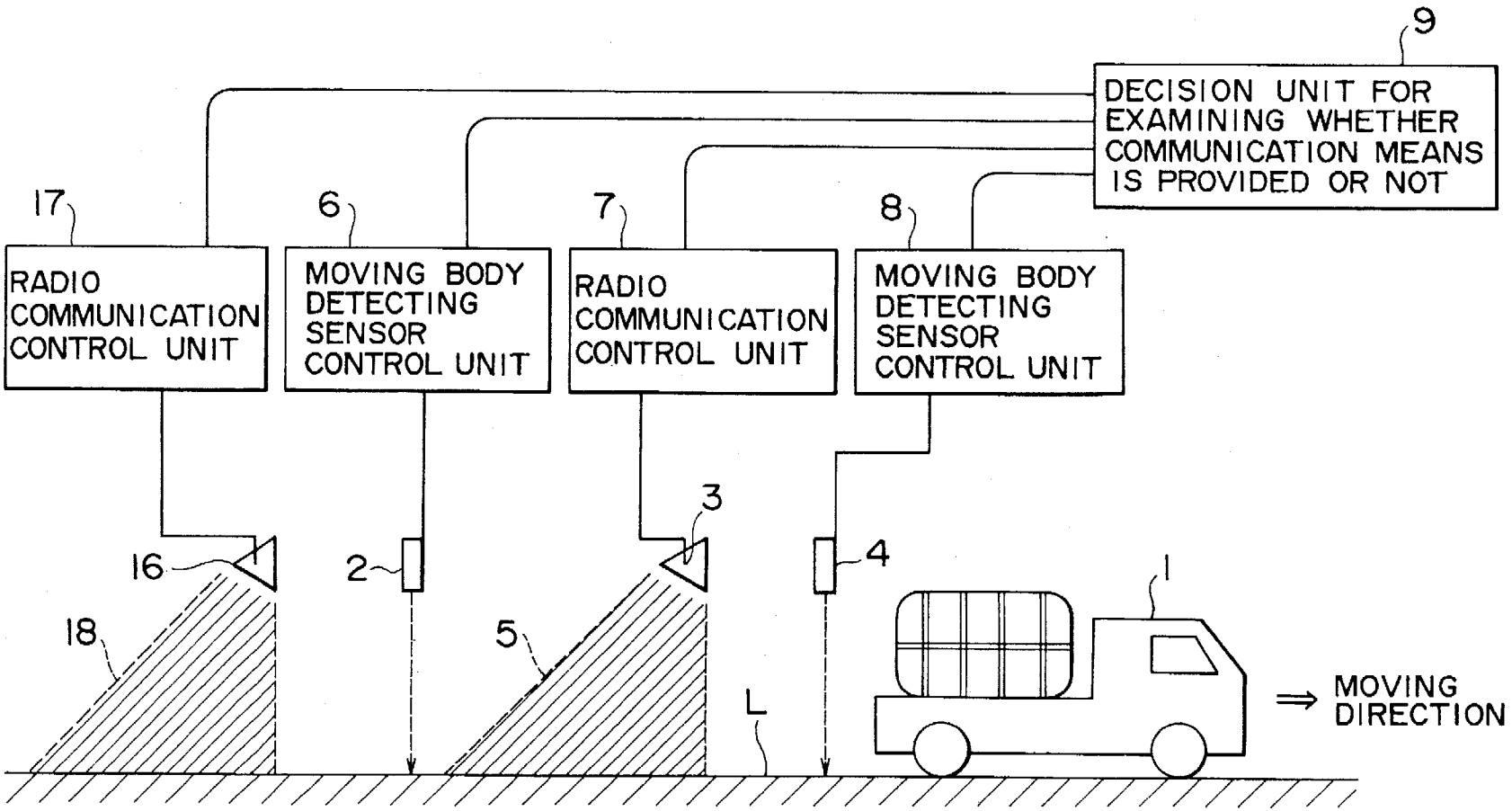
FIG. 7 is a diagram illustrating a configuration in a second embodiment of the present invention.

FIG. 7 schematically illustrates the second embodiment of the present invention.

In FIG. 7, numeral 1 denotes a moving body, 2 a moving body detecting sensor for detecting a front portion of the moving body, 3 an antenna, 4 a moving body detecting sensor for detecting a rear portion of the moving body, 5 a communication area (antenna communication area) of the antenna 3, 6 a control unit for the moving body detecting sensor for detecting the front portion of the moving body, 7 a radio communication control unit, 8 a control unit for the moving body detecting sensor for detecting the rear portion of the moving body, and 9 a decision unit for deciding whether a communication apparatus is present or not. These elements are basically the same as the elements described in FIG. 1. Numeral 16 denotes an antenna, 17 a radio communication control unit, and 18 a communication area by the antenna 16.

This embodiment newly includes the radio communication control unit 17 and the antenna 16 in addition to the configuration shown as the first embodiment of the present invention described above. The radio communication control unit 17 communicates with an external apparatus through the antenna 16 by radio to obtain information and supplies the information together with an ID information (identification information) of the antenna 16 used in the communication to the decision unit 9. The antenna 16 is disposed upstream of the road with respect to the installation position of the moving body detecting sensor 2 and can set a relatively narrow predetermined area as the communication area.

With such a configuration, an approaching moving body 1 communicates with the antenna 16 and then is detected by the moving body detecting sensor 2.

The moving body 1 is configured to transmit an identification code (ID of moving body) peculiar to the moving body to the antenna when the moving body 1 communicates by radio (when the moving body 1 communicates through the antenna).

The identification code of the moving body is sent from the communication apparatus equipped in the moving body through the antenna 16 and the radio communication control unit 17 or through the antenna 3 and the radio communication control unit 7 to the decision unit 9.

Figure 8:
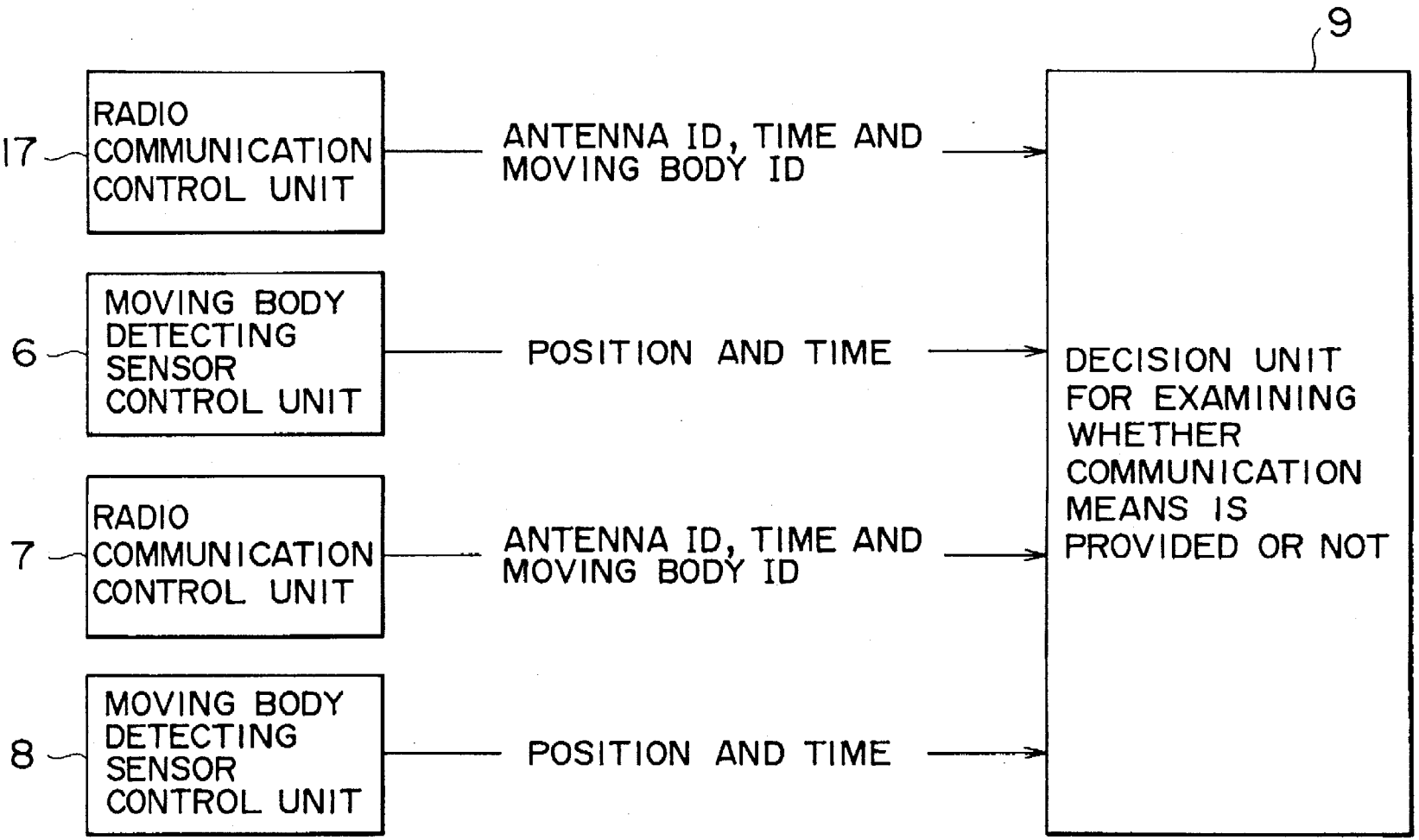
FIG. 8 is a diagram illustrating received information of a decision unit for deciding whether communication is present or not in the second embodiment of the present invention.

FIG. 8 shows primary information sent from each unit to the decision unit 9. The radio communication control unit 17 sends the antenna ID, the time information indicative of the time that the antenna ID is obtained, and the ID of the moving body to the decision unit 9. The moving body detecting sensor control unit 6 sends the position information and the time information indicative of the time that the position information is obtained to the decision unit 9. The radio communication control unit 7 sends the antenna ID, the time information indicative of the time that the antenna ID is obtained, and the ID of the moving body to the decision unit 9. The moving body detecting sensor control unit 8 sends the position information and the time information indicative to the time that the position information is obtained to the decision unit 9.

In the second embodiment, since the following condition can be added to the moving body detection record registered in the communication record, the fact that the moving body detection record having no relation to the communication record is registered in the communication record can be reduced. In other words, when the radio communication telegraphic message obtained by the communication with the communication apparatus of the moving body is caused to correspond to the moving body detection telegraphic message which is the moving body detection record information of the moving body, the fact that the moving body detection telegraphic message except the moving body detection telegraphic message having the relation to the moving body is caused to correspond thereto can be reduced greatly.

Figure 9:
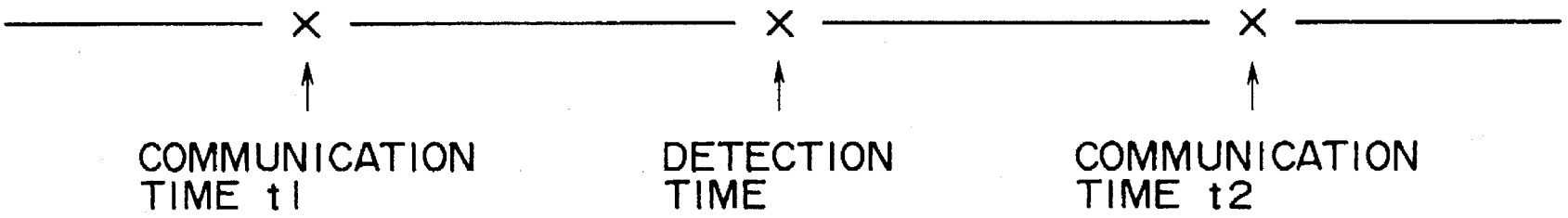
FIG. 9 is a diagram illustrating occurrence order of communication record and detection record in the second embodiment of the present invention.

[Condition 3: The moving body detection record capable of being registered in the communication record is limited to that having the detection time which is positioned between times t1 and t2 recorded in the communication records relative to the same moving body sent from the radio communication control units 17 and 7, respectively, as shown in FIG. 9. The time t1 represents the time information included in the telegraphic message sent by the radio communication control unit 17 and the time t2 represents the time information included in the telegraphic message sent by the radio communication control unit 7.]

The second embodiment has the following processes different from the first embodiment.

(1) When the telegraphic message is received from the radio communication control unit 17, a communication record buffer is acquired and contents of the telegraphic message is stored therein.

(2) When the telegraphic message is received from the radio communication control apparatus 7, reference is made to the ID of the moving body recorded in the telegraphic message and the communication record buffer in which the same ID of the moving body is stored is retrieved.

(3) The received telegraphic message is recorded in the retrieved and detected communication record buffer.

Even in the second embodiment, it is possible to provide the imaging means for taking an image of the moving body which is not equipped with the communication means and specify the vehicle to take an image thereof selectively by the imaging means.

In the system, the ID is assigned to the moving body and the moving body is caused to send information containing the ID. Two particular areas are provided to be positioned before and behind along the traveling direction of the road and communication with the moving body is made within the two particular areas. The communication records thereof containing the time information indicative of the communication time are obtained and the moving body detection information in the particular areas containing the time information indicative of the detection time of the moving body is obtained. Whether the information, particularly the time information and the ID information of the moving body are related to another moving body or not is decided to exclude the information having no relation and whether the moving body is equipped with the communication apparatus or not is decided on the basis of the remaining information. In this case, even when another moving body exists near the moving body to be monitored, the information relative to another moving body can be excluded. Accordingly, whether the moving body to be monitored is equipped with the communication apparatus or not can be decided with higher accuracy.

An embodiment in which whether the moving body is equipped with the communication apparatus or not can be decided at high speed with high accuracy is now described as a third embodiment.

(Third Embodiment)

Figure 10:
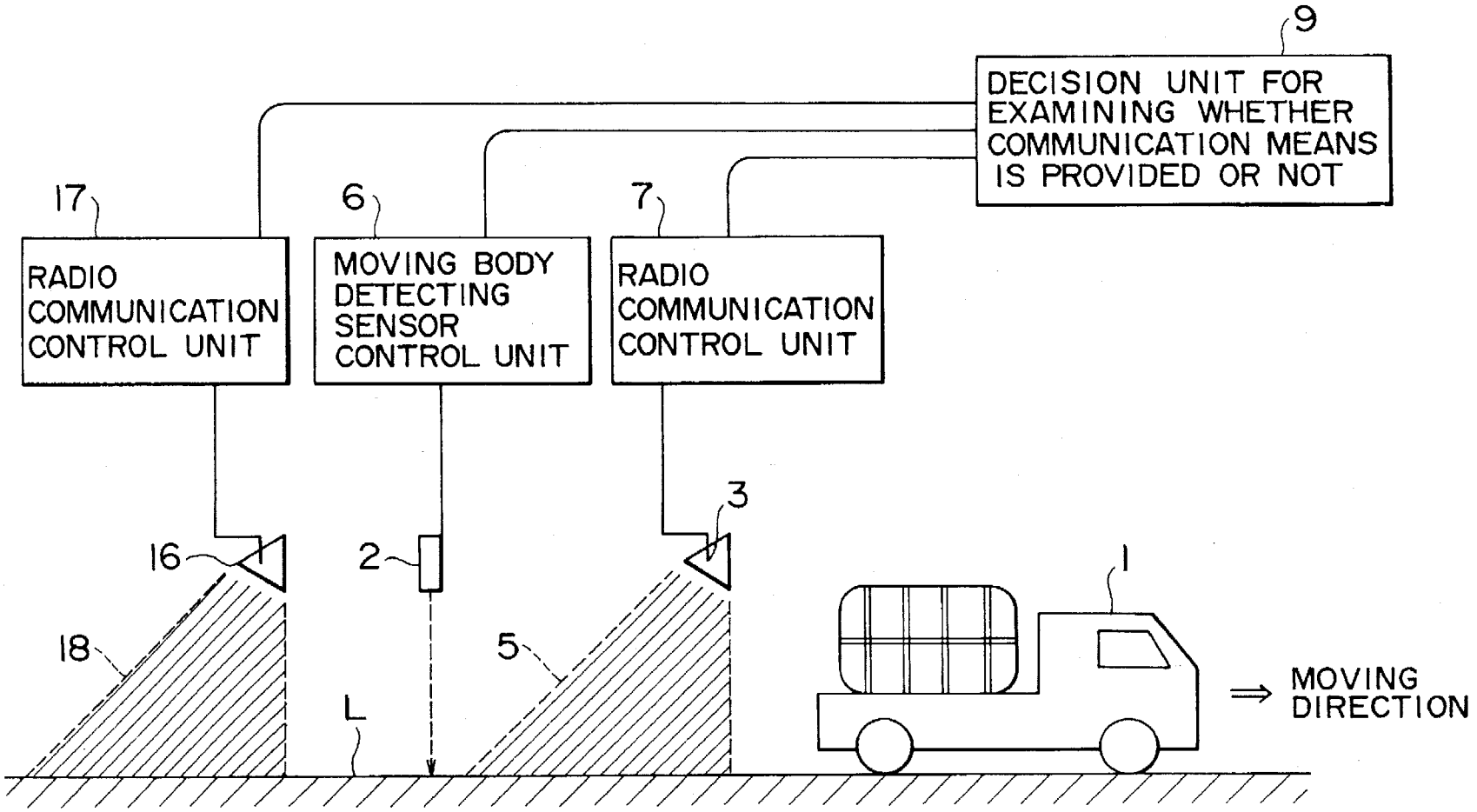
FIG. 10 is a schematic diagram illustrating a configuration in a third embodiment of the present invention.

FIG. 10 schematically illustrates the third embodiment of the present invention.

The third embodiment does not include the moving body detecting sensor 4 and the moving body detecting sensor control unit 8 provided in the second embodiment.

In the third embodiment, the moving body detecting sensor 2 detects both of the leading end and the trailing end of the moving body 1. When the moving body 1 passes by the moving body detecting sensor 2, the moving body detecting sensor control unit 6 sends a telegraphic message having detection information of the leading end and the trailing end of the moving body 1 to the decision unit 9.

Figure 11:
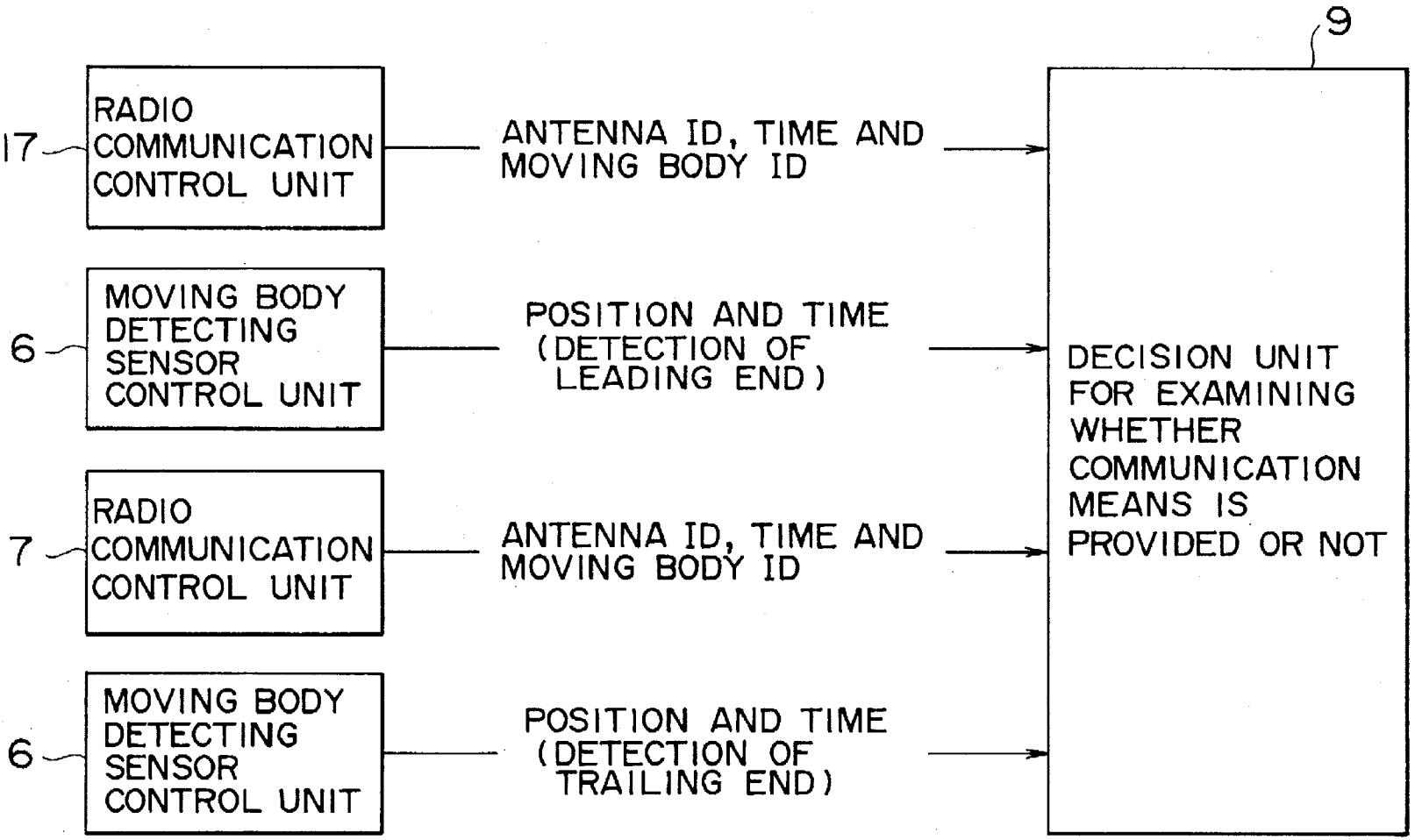
FIG. 11 is a diagram illustrating primary information sent to a decision unit 9 for deciding whether communication means is present or not in the third embodiment of the present invention.

FIG. 11 shows primary information sent from each unit to the decision unit 9. The radio communication control unit 17 sends the antenna ID, the time information indicative of the time that the antenna ID is obtained, and the ID of the moving body to the decision unit 9. The moving body detecting sensor control unit 6 sends the detection position information of the leading end of the moving body, the time information indicative of the time that the detection position information of the leading end is obtained, the detection position information of the trailing end of the moving body, and the time information indicative of the time that the detection position information of the trailing end is obtained to the decision unit 9. The radio communication control unit 7 sends the ID of the antenna, the time information indicative of the time that the ID of the antenna is obtained and the ID of the moving body to the decision unit 9.

In the third embodiment, when the moving body 1 is equipped with the communication apparatus, the communication of the moving body with the antenna 3 is required to be made until the trailing end of the moving body is detected by the moving body detecting sensor 2 after the leading end of the moving body is detected by the sensor 2. When a length of the moving body 1 is short, the order of the communication time and the detection time of the trailing end of the moving body is sometimes reversed. Even in this case, the detection information of the trailing end is delayed in the internal process of the decision unit 9 so that decision by the decision unit can be made exactly.

Figure 12:
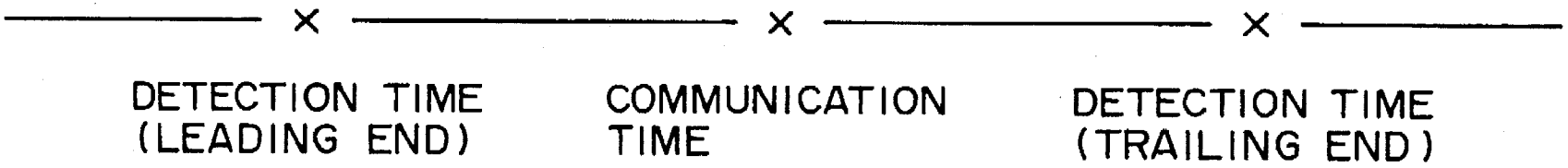
FIG. 12 is a diagram illustrating occurrence order of information obtained from the moving body 1 in the third embodiment.

FIG. 12 shows the order of occurrence of information obtained from the moving body 1 in the third embodiment. That is, the leading end of the moving body 1 is detected by the moving body detecting sensor 2, the communication with the moving body is then made, and thereafter the trailing end of the moving body 1 is detected by the sensor 2.

The detection information of the trailing end of the moving body sent from the moving body detecting sensor control unit 8 in the second embodiment is sent from the moving body detecting sensor control unit 6 in the third embodiment. Accordingly, in the process of the third embodiment, decision as to whether the moving body 1 is equipped with the communication apparatus or not is completed earlier than the second embodiment.

Even in this embodiment, it is possible to add the imaging means and specify the vehicle which is not equipped with the communication apparatus to take an image of the vehicle in the same manner as the above embodiment.

As described above with reference to the embodiment, according to the present invention, whether the moving body detected by the moving body detecting means is equipped with the communication apparatus or not can be decided without limiting the traveling position of the moving body.

Further, as described in the embodiment, the imaging means and the imaging means control unit can be combined to specify the moving body which is not equipped with the communication apparatus and take an image thereof selectively.

In the above-mentioned embodiments, the system of the present invention comprises fixed position side communication means having the narrow communication area, moving body detecting means for detecting the moving body entering into the narrow communication area of the fixed position side communication means without contact with the moving body to output information thereof, and means for deciding whether the moving body is equipped with the communication apparatus or not on the basis of the communication information and the detection information of the fixed position side communication means. The partition required in the conventional method to limit the traveling position of the moving body can be eliminated. Accordingly, the traveling position of the moving body is not limited upon communication and whether the moving body is equipped with the communication apparatus or not can be decided with high accuracy.

In the above embodiment, the detection information and the communication information of the moving body are collected and are caused to correspond to each other, so that whether the monitored moving body is equipped with the communication apparatus or not is decided on the basis of the correspondence.

An embodiment of an apparatus which can examine whether the monitored moving body holds particular information or not is now described. A data base is used and the detection information and the communication information of the moving body are collected. An example of the apparatus which decides whether the monitored moving body has particular information or not on the basis of the above information and information of the data base.

In the example described below, whether the moving body performs communication or not is decided on the basis of the communication result between the moving bodies and the detection result of the moving body detecting means. Further, when a plurality of moving bodies exist simultaneously, communication information confirming means for specifying which moving body of them performs communication is provided newly.

The communication information confirming means selects the detection information and the communication information estimated to be related to the same moving body from detection records obtained from the moving body detecting means and the communication records obtained from the communication means and examines whether the moving body exists within the communicable range at the communication time with reference to information containing the detection position and the detection time of the moving body, the communicable range with the moving body and the communication time. Thus, the communication information confirming means specifies one of the moving bodies which performed communication or decides any one of some candidates and searches the data base in which particular information is registered to decide whether the vehicle has the particular information or not.

There is provided fixed position side communication means having the narrow communication area, moving body detecting means for detecting the moving body entering into the narrow communication area of the fixed position side communication means without contact with the moving body to output information thereof, and means for deciding whether the moving body has the particular information or not on the basis of the communication information and the detection information of the fixed position side communication means. The partition required in the conventional method to limit the traveling position of the moving body can be eliminated. Accordingly, the traveling position of the moving body is not limited upon communication.

(Fourth Embodiment)

Figure 13:
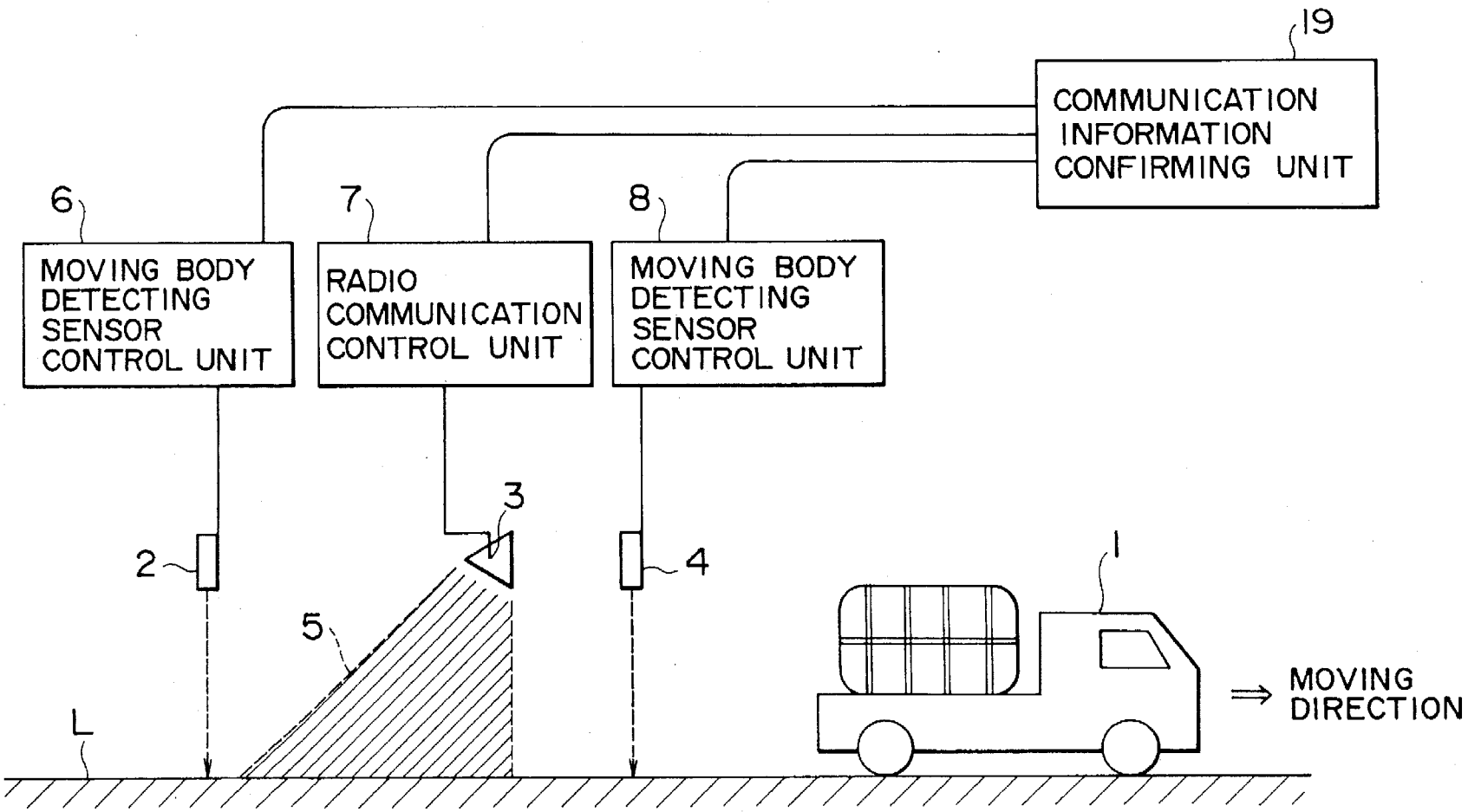
FIG. 13 is a schematic diagram illustrating a configuration in a fourth embodiment of the present invention.

FIG. 13 schematically illustrates a fourth embodiment of the present invention.

In FIG. 13, reference mark L represents the surface of a road, and reference numeral 1 represents a moving body which moves on the road surface L and is a vehicle such as, for example, an automobile capable of moving freely in the forward and backward directions and turning to the right and left. The moving body 1 is equipped with a radio communication apparatus which holds particular information and can transmit the information and communicate with the outside by radio as communication means. Numerals 2 and 4 denote moving body detecting sensors. The moving body detecting sensors 2 and 4 use, for example, CCD line sensors, ultrasonic sensors, laser scanners or the like. The moving body detecting sensor 2 is adapted to detect a leading end portion of the moving body 1 and the moving body detecting sensor 4 is adapted to detect a trailing end of the moving body 1. Further, the moving body detecting sensors 2 and 4 can produce positional information in the width direction of the moving body 1. The moving body detecting sensor 4 is disposed downstream of the road with a predetermined space from the installation point of the moving body detecting sensor 2.

Numeral 6 and 8 denotes a moving body detecting sensor control unit. The moving body detecting sensor control unit 6 has a clock function and uses a detection output obtained when the moving body detecting sensor 2 detects the leading end portion of the moving body 1 to calculate detection position information of the moving body 1 in the width direction of the road. The moving body detecting sensor control unit 6 further sends the calculated detection position information together with time information at the time that the moving body is detected to a communication information confirming unit 19. In addition, the moving body detecting sensor control unit 8 also has a clock function and uses a detection output obtained when the moving body detecting sensor 4 detects the trailing end portion of the moving body 1 to calculate detection position information of the moving body 1 in the width direction of the road. The moving body detecting sensor control unit 8 further sends the calculated detection position information together with time information at the time that the moving body is detected to the communication information confirming unit 190

Numeral 3 denotes an antenna which is located between the moving body detecting sensors 2 and 4. The antenna 3 is connected to the radio communication control unit 7, which can communicate with the communication apparatus of the moving body 1 through the antenna 3 by radio. The radio communication control unit 7 sends information obtained in the communication together with ID information (identification information) of the antenna 3 used in the communication to the communication information confirming unit 19.

The communication information confirming unit 19 can decide whether the moving body 1 is equipped with the communication apparatus or not on the basis of the information (the detection position information of the moving body 1 and the time information upon detection of the moving body 1) obtained from the moving body detecting sensor control unit 6 and 8 and the information obtained from the radio communication control unit 7. Further, the communication information confirming unit 19 includes a data base and can search the data base for various particular information to be collated. The communication information confirming unit 19 can examine whether the particular information in the data base is included in the information obtained from the radio communication control unit 7 or not and outputs the result thereof.

Operation of the apparatus with such a configuration is now described.

The radio communication apparatus equipped in the moving body 1 is disposed at the center position in the width direction of the moving body 1 and behind the front end of the moving body 1. When the moving body 1 travels on the road and comes near or reaches the moving body detecting sensor 2, the moving body detecting sensor 2 detects the moving body 1 and supplies the detection output to the moving body detecting sensor control unit 6. Further, when the moving body 1 comes near or reaches the moving body detecting sensor 4, the sensor 4 detects the moving body 1 and supplies the output to the sensor control unit 8.

The sensor control unit 6 obtains the time information (arrival time) that the front portion of the moving body 1 comes near or reaches the moving body detecting sensor 2 and the position information of the front portion on the basis of the detection information supplied thereto and sends the information to the communication information confirming unit 19 as a moving body detection telegraphic message. The sensor control unit 8 obtains the time information (arrival time) that the rear portion of the moving body 1 comes near or reaches the moving body detecting sensor 4 and the position information of the rear portion on the basis of the detection information supplied thereto and sends the information to the communication information confirming unit 19 as a moving body detection telegraphic message.

The antenna 3 transmits and receives electric waves under control of the radio communication control unit 7 to communicate with the moving body 1. The radio communication control unit 7 sends the communication information together with the ID information of the antenna 3 used for the communication to the communication information confirming unit 19.

The antenna 3 is disposed above the road surface L, that is, above the road on which the moving body 1 travels and at least one or two or more antennas are disposed side by side in the width direction of the road surface (in the width direction of the lane of the road). The antenna 3 has a predetermined communication area in the width direction of the road surface, that is, in the width direction of the lane of the road. When a plurality of antennas 3 are provided, the communication areas of the antennas may be overlapped with each other.

Figure 14:
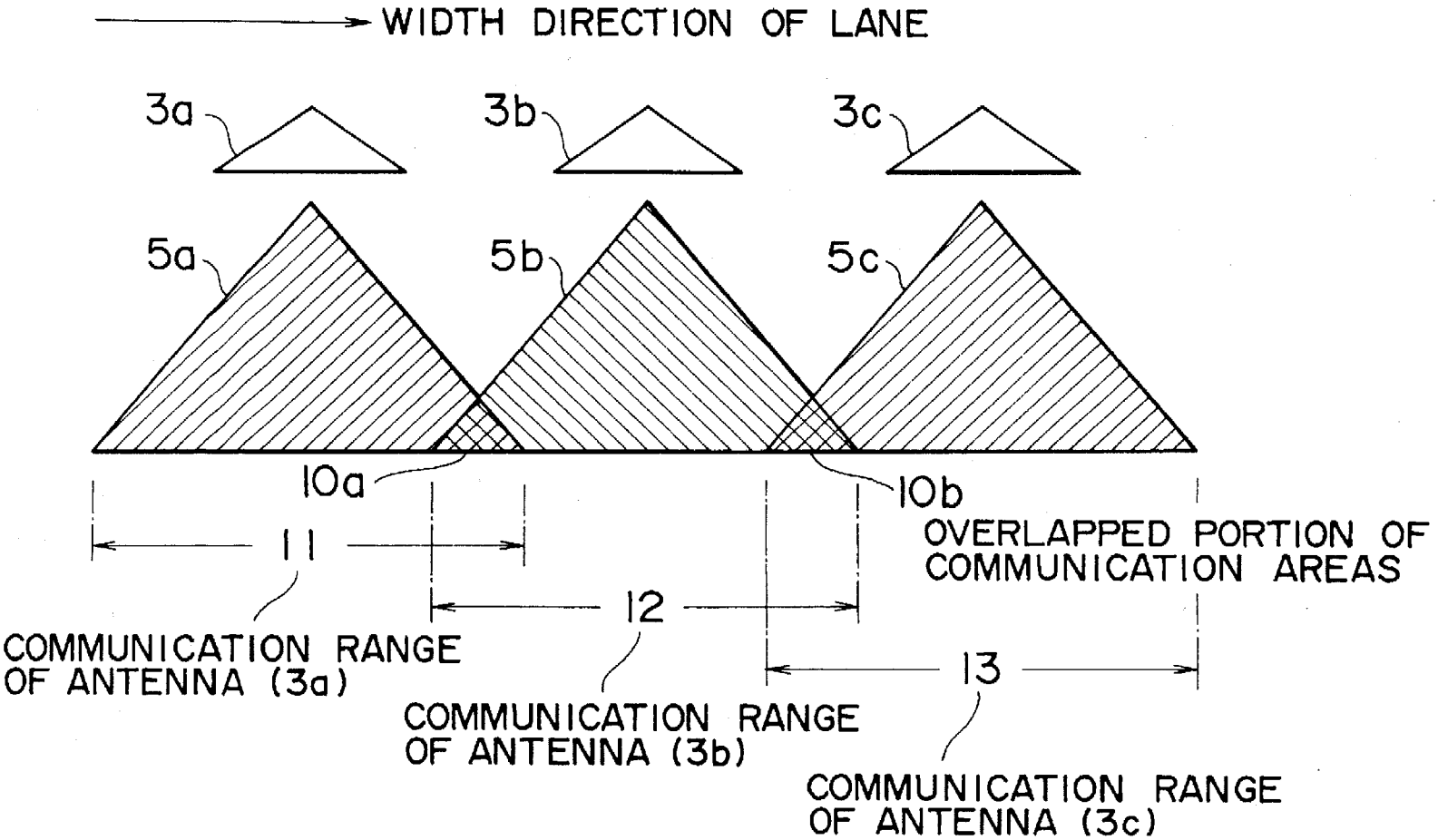
FIG. 14 is a diagram illustrating communication antennas and communication ranges thereof in the fourth embodiment of the present invention.

As an example thereof, FIG. 14 shows the case where three antennas 3*a* to 3*c* are disposed in the width direction of the lane of the road in order. In FIG. 14, communication areas 5*a* to 5*c* of the antennas 3*a* to 3*c* are partially overlapped with each other. In FIG. 14, numeral 11 represents a communication range of the antenna 3*a* which is an area covered by the communication area 5*a*, numeral 12 represents a communication range of the antenna 3*b* which is an area covered by the communication area 5*b*, numeral 13 represents a communication range of the antenna 3*c* which is an area covered by the communication area 5*c*, and numerals 10*a* to 10*b* represent areas of overlapped portions of the communication areas.

These antennas 3 are connected to the radio communication control unit 7 to communicate with the moving body 1. The radio communication control unit 7 sends the communication record with the moving body 1 through a communication route to the communication information confirming unit 19 as a radio communication telegraphic message.

Figure 15:
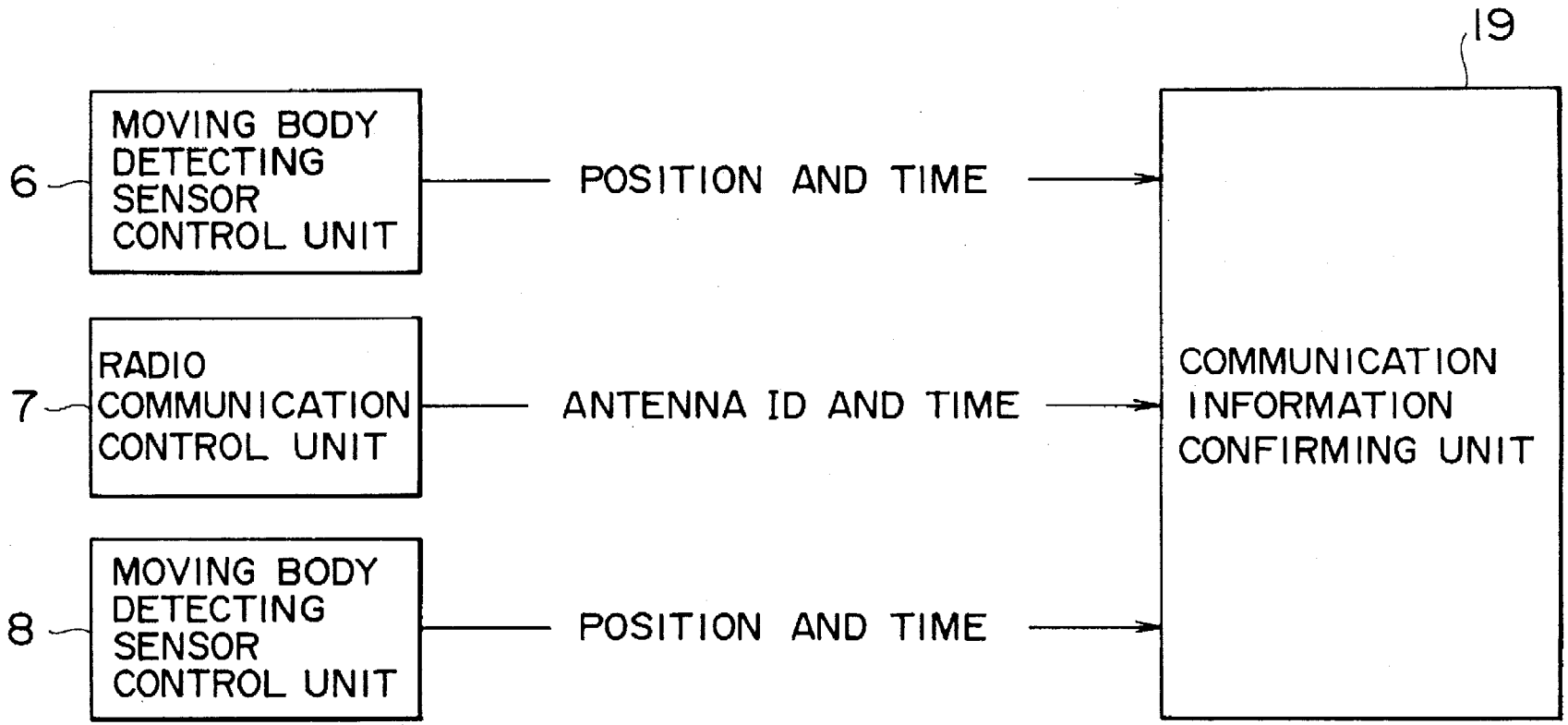
FIG. 15 is a diagram illustrating received information of a communication information confirming unit in the fourth embodiment of the present invention.
Figure 16A:
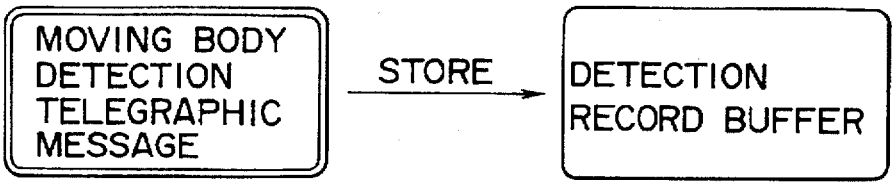
FIGS. 16(*a*)–16(*e*) are diagrams illustrating processing of information in the communication information confirming unit in the fourth embodiment of the present invention.
Figure 16B:
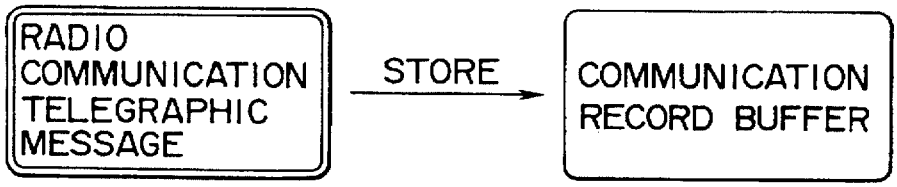
Figure 16C:
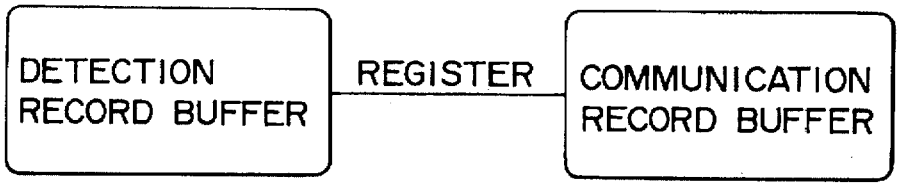
Figure 16D:
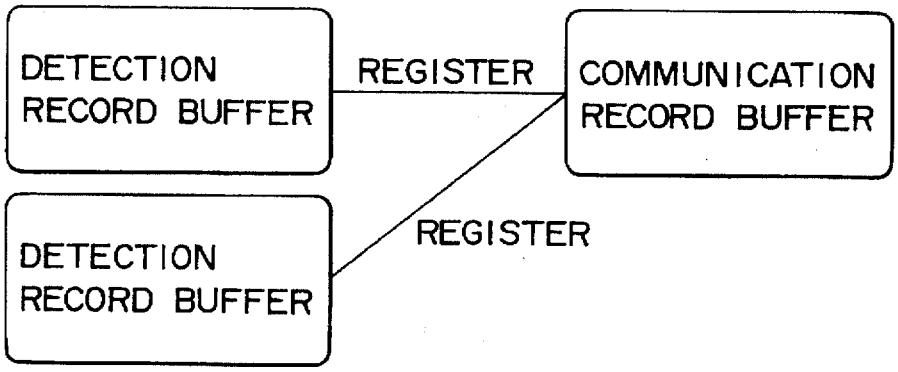
Figure 16E:
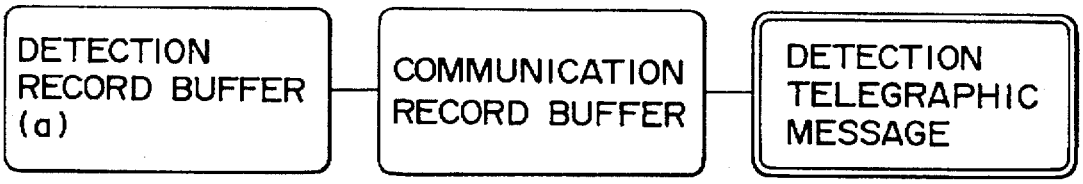

FIG. 15 shows primary information which is sent from the moving body detecting sensor control units 6 and 8 and the radio communication control unit 7 to the communication information confirming unit 19.

As shown in FIG. 15, the information sent from the moving body detecting sensor control units 6 and 8 to the communication information confirming unit 19 includes the detection position information of the moving body 1 in the width direction of the road and the detection time information. Further, the information sent from the radio communication control unit 7 to the communication information confirming unit 9 includes the identification number (ID of the antenna) of the antenna 3 or (3*a*, 3*b* or 3*c*) used for communication with the moving body 1 and the communication time.

The antenna communicating with the moving body 1 is detected on the basis of the identification number of the antenna.

The communication information confirming unit 19 which has received such information performs the following process to decide whether the moving body is equipped with the communication apparatus or not. That is, the communication information confirming unit 19 receives a telegraphic message of transmission information from the sensor control unit 6, the radio communication unit 7 and the sensor control unit 8 in order of the units 6, 7 and 8 in response to movement of one moving body 1. Thus, the communication information confirming unit 19 performs the following process.

[1] The communication information confirming unit 19 receives the moving body detection telegraphic message from the sensor control unit 6 and then stores the contents of the message in a detection recording and preserving buffer formed in a memory area included in the communication information confirming unit (FIG. 16(*a*)).

[2] When the communication information confirming unit 19 receives the radio communication telegraphic message from the radio communication control unit 7, the communication information confirming unit 19 forms a communication recording buffer for preserving the contents, of the message in the memory area or the buffer area included in the communication information confirming unit 19 and stores the contents of the received telegraphic message in the memory area or the buffer area (FIG. 16(*b*)).

[3] The communication information confirming unit 19 then searches information satisfying the same condition 1 as that of the first embodiment from detection recording information (moving body detection telegraphic message) stored in the detection recording and preserving buffer and registers or records contents of the searched detection recording buffer or a position of the buffer in the communication recording buffer in which the radio communication telegraphic message is stored to thereby form the correspondence therebetween (FIG. 16(*c*)).

The contents of the condition 1 is that "the record including the detection position in the width direction of the moving body 1 is within the communication range of the antenna specified by the antenna ID stored in the telegraphic message (radio communication telegraphic message) received from the radio communication control unit 7".

The communication area of the antenna is within the section between the moving body detecting sensors 2 and 4 and is positioned from just after the detection position of the moving body detecting sensor 2 (downstream direction of the road, that is, just forward in the traveling direction of the moving body). Accordingly, the detection position can correspond to the communication area and a corresponding detection record can be found out from the communication record.

[4] When a plurality of detection records (moving body detection telegraphic messages) can correspond to one communication record (radio communication telegraphic message) simultaneously, all of the moving body detection records (moving body detection telegraphic messages) are treated as moving body detection telegraphic messages for the same moving body and are registered or recorded in the communication record buffer to be able to correspond to the corresponding radio communication telegraphic messages (FIG. 16(*d*)).

[5] After a telegraphic message (moving body detection telegraphic message) has been received from the moving body detecting sensor control unit 8 for detection of the trailing end of the moving body, whether the particular information exists in the communication records satisfying the same "condition 2" as that of the first embodiment or not is examined.

The condition 2 is that "the record including a detection position in the width direction of the moving body 1 recorded in the telegraphic message (moving body detection telegraphic message) received from the moving body detecting sensor 4 for detecting the trailing end of the moving body 1 is within the communication range of the antenna".

Figure 17:
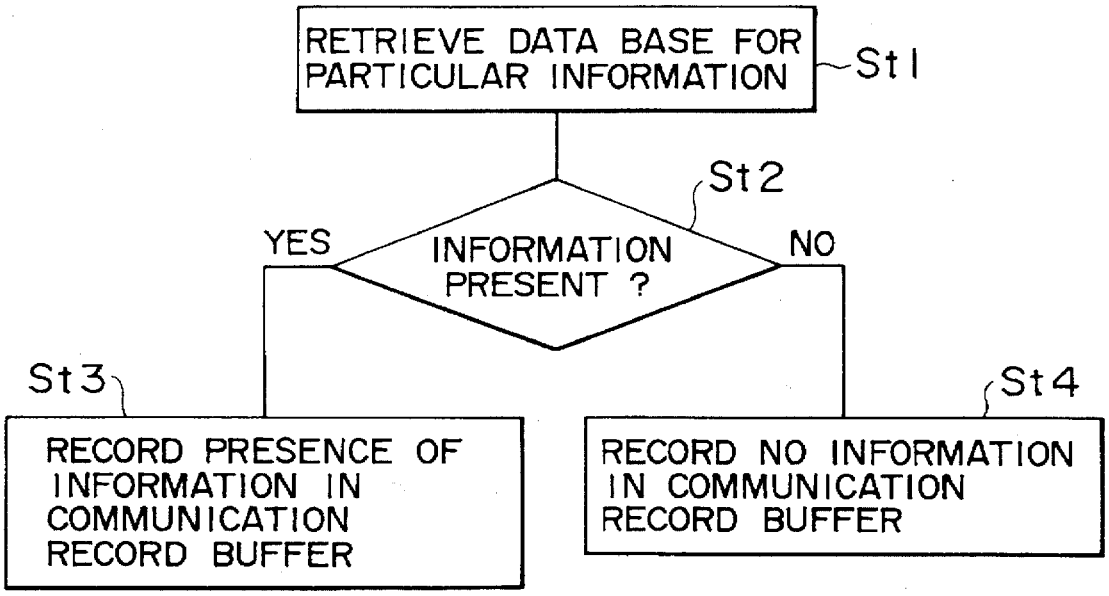
FIG. 17 is a diagram illustrating processing of information in the communication information confirming unit in the fourth embodiment of the present invention.
Figure 18:
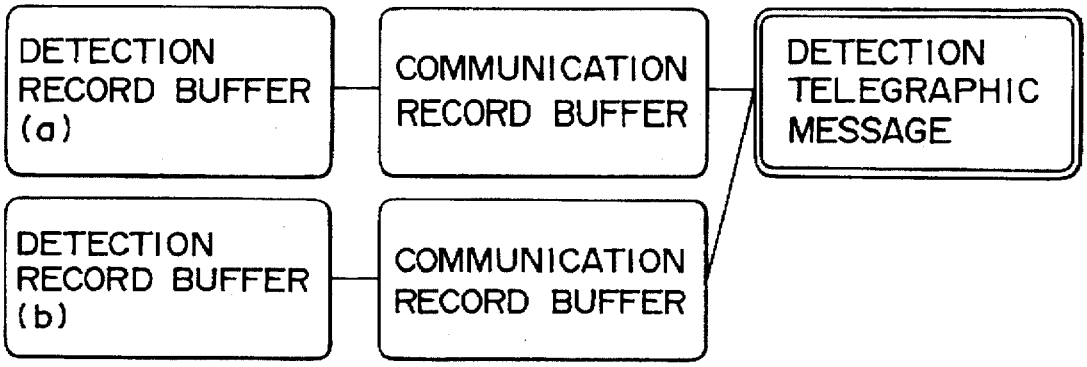
FIG. 18 is a diagram illustrating processing of information in the communication information confirming unit in the fourth embodiment of the present invention.

The decision as to whether the "particular information" is present or not is made by retrieving the data base for particular information provided in the communication confirming unit 19 and examining whether the particular information is included in the information stored in the communication records or not. When it is detected that the particular information exists in the communication records, information indicative of "presence of the particular information" is recorded in the communication records. When there is no particular information, information indicative of "no particular information" is recorded in the communication records. FIG. 17 is a flow chart showing the above process in brief.

When the communication information confirming unit 19 obtains the information, the data base for particular information included therein is retrieved (St1). Whether the information stored in the communication records contains the information coincident with the information stored in the data base for particular information or not is decided by comparison to thereby examine whether there is the particular information or not (St2). Consequently, when it is detected that the particular information is included in the communication records, information indicative of "presence of the particular information" is recorded in the communication records (St3). Further, as a result of the examination, when it is detected that the particular information is not included in the communication records, information indicative of "no particular information" is recorded in the communication records (St4).

FIG. 16(*e*) shows an example of the registered state of the detection record and the communication record after the moving body detection telegraphic message from the moving body detecting sensor control unit 8 has been received.

The moving body detection sensor 4 detects the trailing end of the moving body. When the moving body 1 is equipped with a normal radio communication apparatus, communication of the radio communication control unit 7 and the moving body 1 has been already completed at the time that the trailing end of the moving body 1 is detected by the moving body detecting sensor 4. Accordingly, communication capable of being performed between the moving body 1 and the radio communication control unit until the moving body 1 passes through the radio communication control unit has been all completed and the number of communication records satisfying the above condition is examined to thereby determine the number of communication records performed between the moving body 1 and the radio communication control unit.

[6] Whether the information indicative of "presence of the particular information" which is the record indicating that the particular information is found out in the communication records (radio communication telegraphic messages) satisfying the condition of the item [5] or whether the information indicative of "no particular information" which the record indicating that the particular information is not found out in the communication records is examined to understand whether the particular information is present or not.

In this case, when the record of information is occasionally present, meaning that the particular information has been found out in all of the communication records, it is decided that the moving body 1 detected by the moving body detecting sensor 4 has the particular information.

When there is no record of information meaning that the particular information has been found out in all of the communication records, it is decided that the moving body 1 detected by the moving body detecting sensor 4 does not have the particular information.

When there is the record of information meaning that the particular information has been found out in not all but some communication records, it is decided that there is a possibility that the moving body 1 detected by the moving body detecting sensor 4 has the particular information.

As described above, the fourth embodiment has the particular detection and comprises the detection means for detecting the moving body passing through the detection area, the communication means for communicating with the moving body in the detection area position, and the communication information confirming apparatus for specifying the communication information with the monitored moving body on the basis of the detection information and the communication information obtained from the detection means and the communication means and examining whether the specified communication information includes the predetermined particular information or not with reference to the data base for particular information to register the result thereof in correspondence with the communication information and decide whether the monitored moving body has the particular information or not from the registered result.

The system includes the particular detection area and detects the moving body passing through the detection area by the detection means. Further, communication with the moving body in the detection area position is performed by the communication means. The communication information confirming unit specifies the communication information with the monitored moving body on the basis of the detection information and the communication information obtained from the detection means and the communication means and examines whether the specified communication information includes the predetermined particular information or not with reference to the data base for particular information. The result thereof is registered in correspondence with the communication information. Whether the monitored moving body has the particular information or not is decided on the basis of the registered result to thereby decide whether the moving body does not have the particular information or not.

Further, when the moving body having no particular information is detected or when the moving body having the particular information is detected or when the moving body possibly having the particular information is detected, the imaging means can be added to the fourth embodiment shown in FIG. 13 and the moving body is specified on condition that the particular information is included or the particular is possibly included or the particular information is not included to take an image of the moving body by the imaging means selectively.

Figure 19:
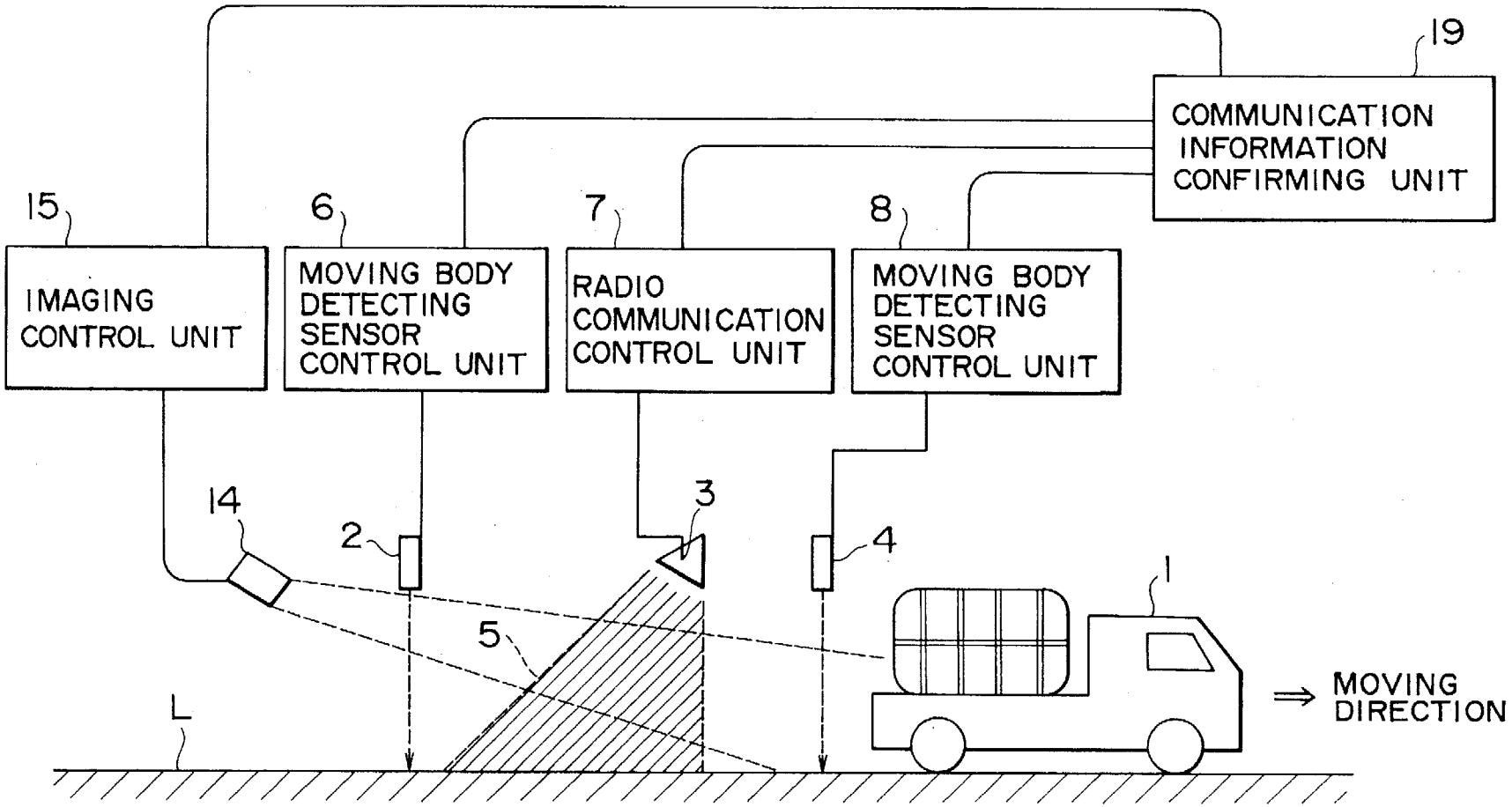
FIG. 19 is a schematic diagram illustrating a configuration including an imaging unit 14 disposed to be able to record a moving body passing through a detection position of a moving body detecting sensor 4 for detecting a trailing end of the moving body in an imaging area and an imaging control unit 15 operated in accordance with a decision result of a decision unit 9 for deciding whether communication means is present or not and controlling the imaging unit 14 in addition to the configuration of the apparatus of the first embodiment.

FIG. 19 schematically illustrates the configuration example in the case where the imaging unit and a control unit of the imaging unit are added. This system includes, in addition to the configuration of the fourth embodiment shown in FIG. 13, an imaging unit 14 disposed to set in the imaging area the moving body passing through the detection position of the moving body detecting sensor 4 for detecting the trailing end of the moving body and an imaging control unit 15 operated in response to the decision result of the communication information confirming unit 19 to control the imaging unit 14.

In the system, an image of the moving body 1 having no particular information or possibly having the particular information is recorded by the imaging unit 14 from the rear portion thereof. The imaging trigger is sent from the communication information confirming unit 19 to the imaging control unit 15 when the communication information confirming unit 19 decides that the moving body 1 does not have the particular information or possibly has the particular information. The imaging control unit 15 can control the imaging unit 14 and record an image of the moving body. The imaging unit 14 can use, for example, a CCD camera (camera using a solid imaging element), a television camera, a still camera or the like.

In this example, the imaging unit 14 is disposed to view from the upstream side to the downstream side of the road and take an image of the moving body 1 from the rear portion of the moving body 1, while there is a case where an image of the moving body 1 is taken from the front portion of the moving body 1. In this case, the imaging unit may be disposed forward in the traveling direction of the moving body 1 toward the moving body.

In the system, communication with the moving body is performed only in one particular area and the communication record of the monitored moving body is specified on the basis of the communication record and the moving body detection information in the particular area. Whether the moving body has the particular information or not is decided with reference to information of the data base in which predetermined particular information is stored. In this case, when another moving body exists near the monitored moving body, whether the monitored moving body has the particular information or not cannot be decided and there is a possibility that decision is inclined to vague contents that there is a possibility that the moving body has the particular information. It is desirable for improvement of reliability that the vagueness is reduced even slightly and whether the particular information is included or not is decided with higher accuracy and higher conviction.

(Fifth Embodiment)

Figure 20:
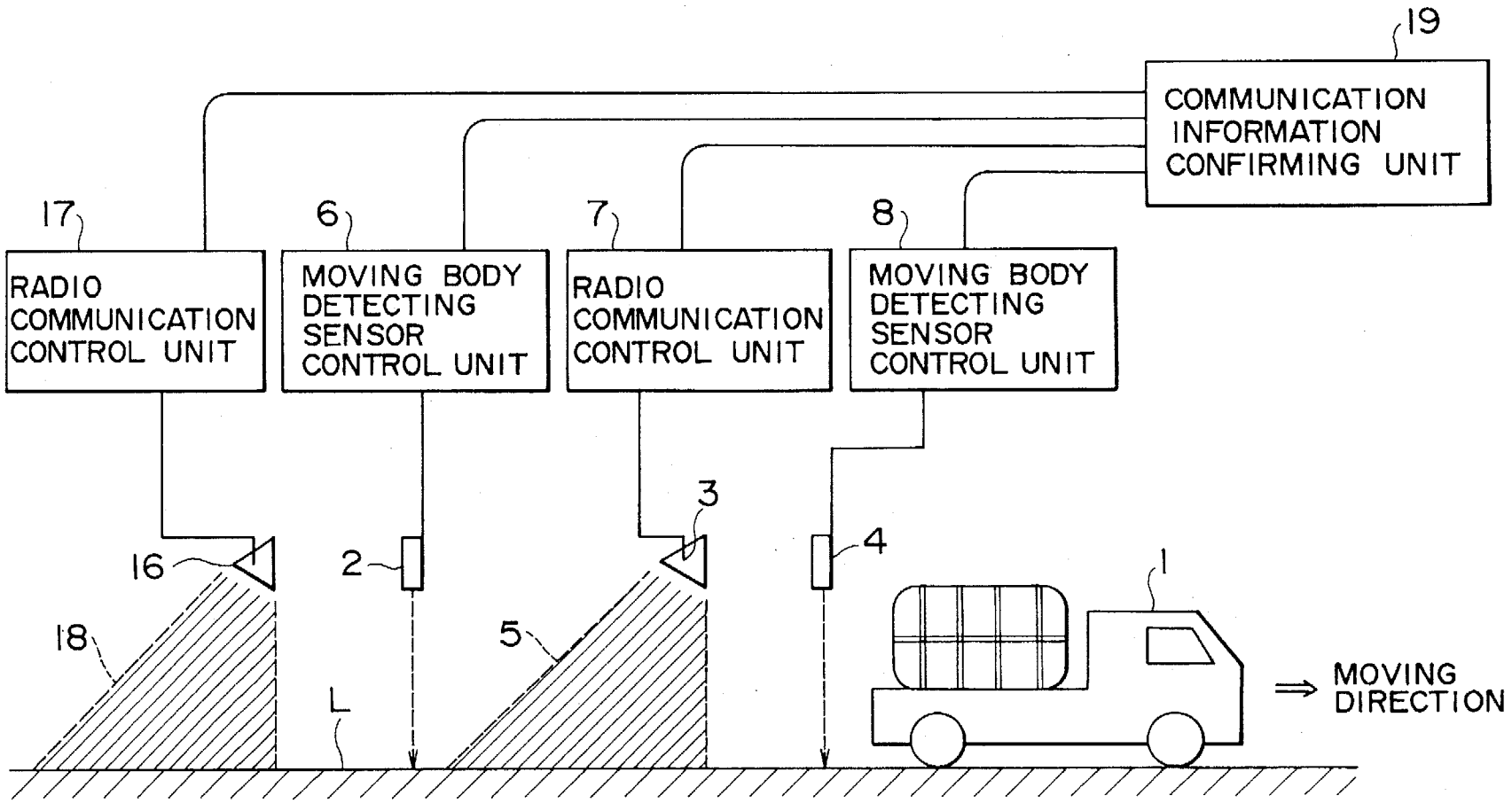
FIG. 20 is a schematic diagram illustrating a configuration in a fifth embodiment of the present invention.

FIG. 20 is a schematic diagram illustrating a fifth embodiment of the present invention.

In FIG. 20, numeral 1 denotes a moving body, 2 a moving body detecting sensor for detecting a front portion of the moving body, 3 an antenna, 4 a moving body detecting sensor for detecting a rear portion of the moving body, 5 a communication area (antenna communication area) of the antenna 3, 6 a control unit for the moving body detecting sensor for detecting the front portion of the moving body, 7 a radio communication control unit, 8 a control unit for the moving body detecting sensor for detecting the rear portion of the moving body, and 19 a communication information confirming unit. These elements are basically the same as the elements described in FIG. 13. Numeral 16 denotes an antenna, 17 a radio communication control unit, and 18 a communication area by the antenna 16.

This embodiment newly includes the radio communication control unit 17 and the antenna 16 in addition to the configuration shown as the fourth embodiment of the present invention described above. The radio communication control unit 17 communicates with the outside through the antenna 16 by radio to obtain information and supplies the information together with an ID information (identification information) of the antenna 16 used in the communication to the communication information confirming unit 19. The antenna 16 is disposed upstream of the road with respect to the installation position of the moving body detecting sensor 2 and can set a relatively narrow predetermined area as the communication area.

With such a configuration, the moving body 1 communicates with the antenna 16 and then is detected by the moving body detecting sensor 2.

The moving body i transmits an identification code (ID of moving body) peculiar to the moving body to the antenna when the moving body 1 communicates by radio (when the moving body 1 communicates through the antenna).

The identification code of the moving body is sent from the communication apparatus equipped in the moving body through the antenna 16 and the radio communication control unit 17 or through the antenna 3 and the radio communication control unit 7 to the communication information confirming unit 19.

Figure 21:
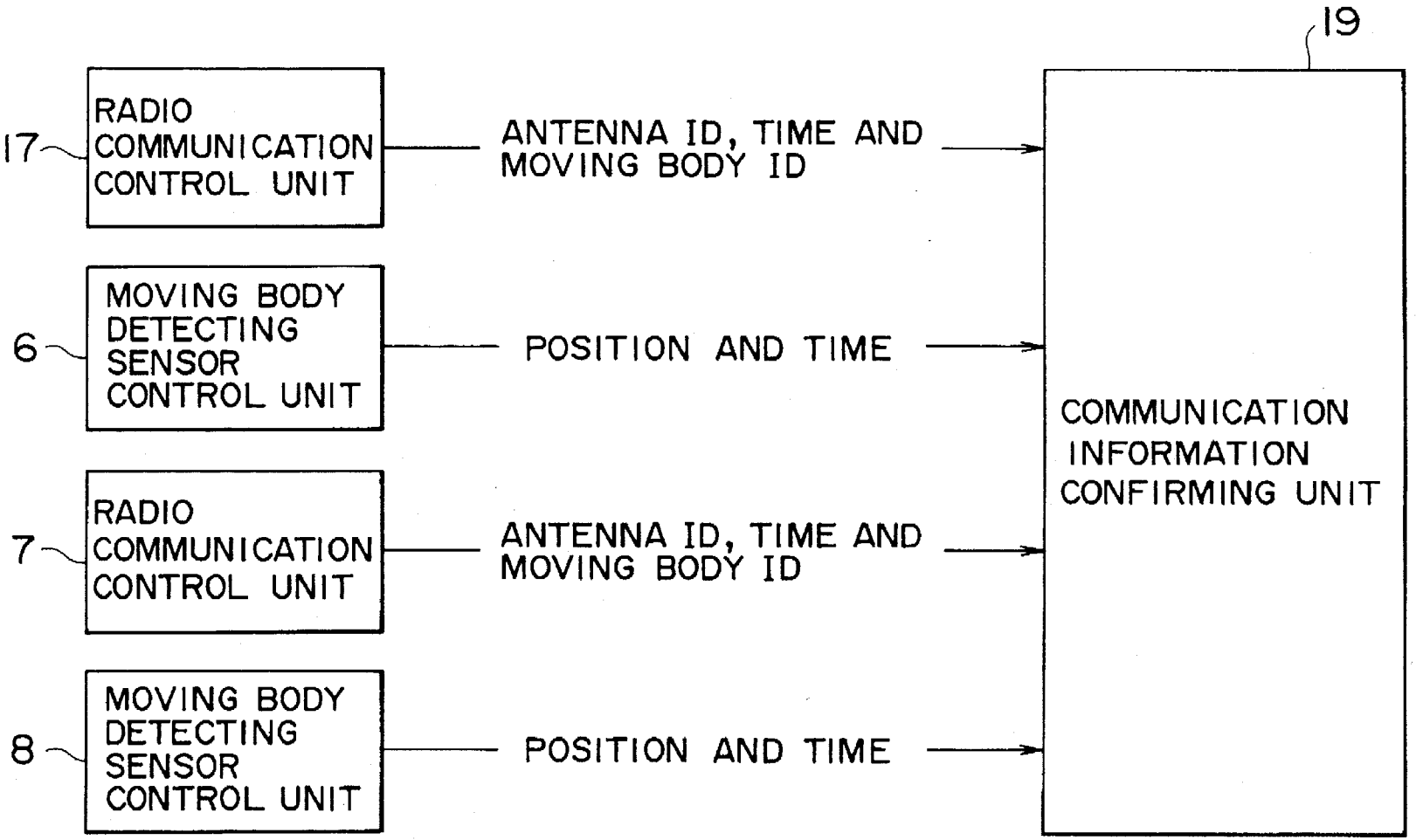
FIG. 21 a diagram illustrating received information of a communication information confirming unit in the fifth embodiment of the present invention.

FIG. 21 shows primary information sent from each unit to the communication information confirming unit 19. The radio communication control unit 17 sends the antenna ID, the time information indicative of the time that the antenna ID is obtained, and the ID of the moving body to the communication information confirming unit 19. The moving body detecting sensor control unit 6 sends the position information and the time information indicative of the time that the position information is obtained to the communication information confirming unit 19. The radio communication control unit 7 sends the antenna ID, the time information indicative of the time that the antenna ID information is obtained, and the ID of the moving body to the communication information confirming unit 19. The moving body detecting sensor control unit 8 sends the position information and the time information indicative to the time that the position information is obtained to the communication information confirming unit 19.

In the fifth embodiment, since the same condition [3] as that used in the second embodiment can be added to the moving body detection record registered in the communication record, the fact that the moving body detection record having no relation to the communication record is registered in the communication record can be reduced. In other words, when the radio communication telegraphic message obtained by the communication with the communication apparatus of the moving body is caused to correspond to the moving body detection telegraphic message which is the moving body detection record information of the moving body, the fact that the moving body detection telegraphic message except the moving body detection telegraphic message having the relation to the moving body is caused to correspond thereto can be reduced greatly.

Figure 22:
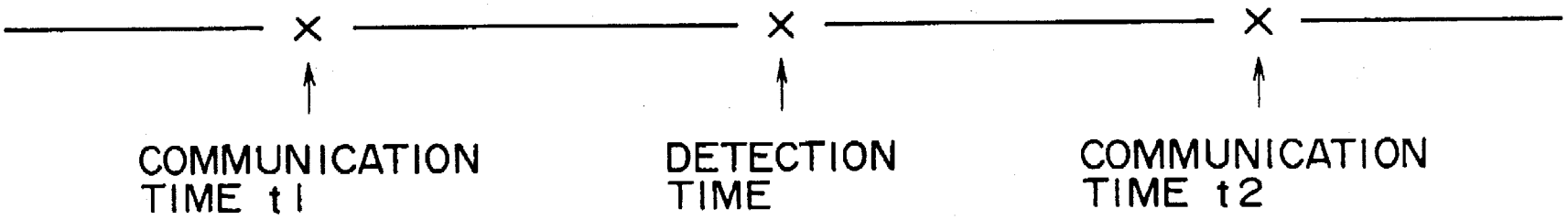
FIG. 22 is a diagram illustrating occurrence order of communication record and detection record in the fifth embodiment of the present invention.

The contents of the [condition 3] is that "the moving body detection record capable of being registered in the communication record is limited to that having the detection time which is positioned between times recorded in the communication records relative to the same moving body sent from the radio communication control units 17 and 7, respectively, as shown in FIG. 22". The time t1 represents the time information included in the telegraphic message sent by the radio communication control unit 17 and the time t2 represents the time information included in the telegraphic message sent by the radio communication control unit 7.

The fifth embodiment has the following processes different from the fourth embodiment.

(1) When the telegraphic message is received from the radio communication control unit 17, a communication record buffer is acquired and contents of the telegraphic message is stored therein.

(2) When the telegraphic message is received from the radio communication control apparatus 7, reference is made to the ID of the moving body recorded in the telegraphic message and the communication record buffer in which the same ID of the moving body is stored is retrieved.

(3) The received telegraphic message is recorded in the retrieved and detected communication record buffer.

Even in the fifth embodiment, there is a method in which the imaging means for taking an image of the moving body on condition that the particular information is included or is not included or is possibly included is provided and the vehicle is specified to record an image thereof selectively.

As described above, the ID is included in the moving body and the moving body is caused to send information containing the ID. Two particular areas are provided to be positioned before and behind along the traveling direction of the road and communication with the moving body is made within the two particular areas. The communication records thereof containing the time information indicative of the communication time are obtained. The moving body detection information in the particular areas containing the time information indicative of the detection time of the moving body is obtained. Whether the information, particularly the time information and the ID information of the moving body are related to another moving body or not is decided to exclude the information having no relation and whether the moving body has the particular information or not is decided on the basis of the remaining information. In this case, even when another moving body exists near the moving body to be monitored, the information relative to another moving body can be excluded. Accordingly, whether the moving body to be monitored has the particular information or not can be decided with higher accuracy to thereby reduce the vagueness.

An embodiment in which whether the moving body has the particular information or not can be decided at high speed with high accuracy is now described as a sixth embodiment.

(Sixth Embodiment)

Figure 23:
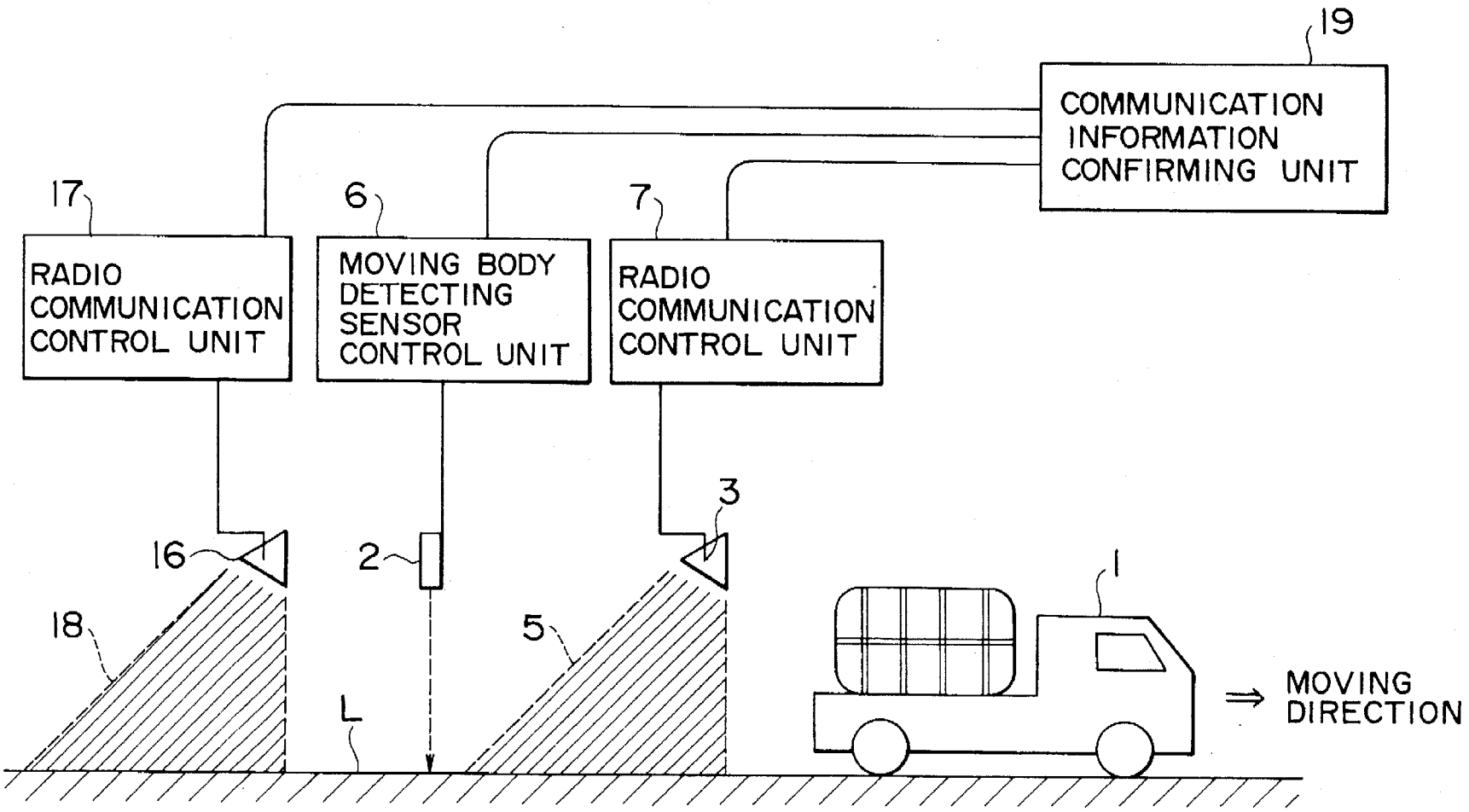
FIG. 23 is a schematic diagram illustrating a configuration in a sixth embodiment of the present invention.

FIG. 23 schematically illustrates the sixth embodiment of the present invention.

The sixth embodiment does not include the moving body detecting sensor 4 and the moving body detecting sensor control unit 8 provided in the fifth embodiment.

In the sixth embodiment, the moving body detecting sensor 2 detects both of the leading end and the trailing end of the moving body 1. Accordingly, when the moving body 1 passes by the moving body detecting sensor 2, the moving body detecting sensor control unit 6 sends a telegraphic message having detection information of the leading end and the trailing end of the moving body 1 to the communication information confirming unit 19.

Figure 24:
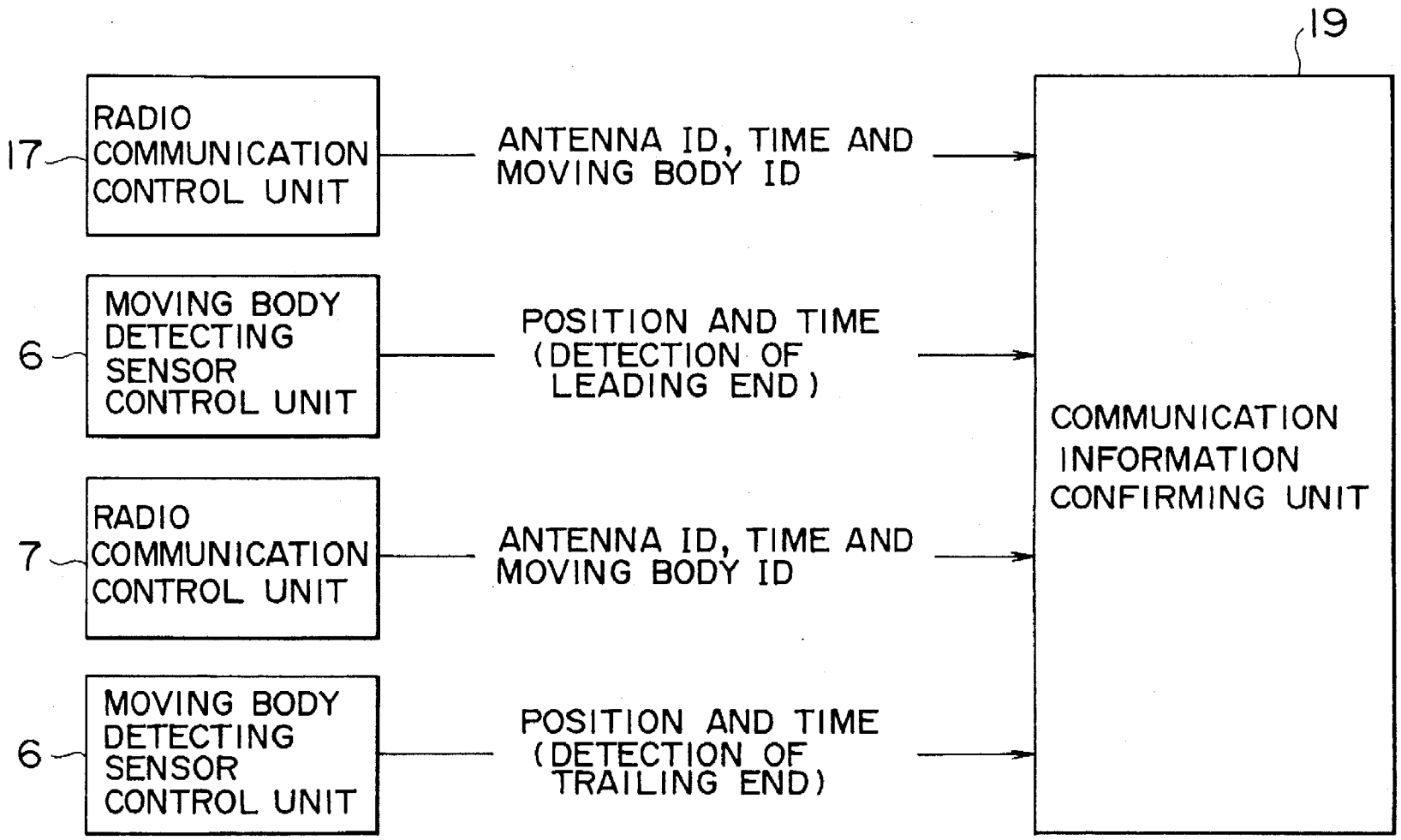
FIG. 24 is a diagram illustrating primary information sent to a communication information confirming unit 19 in the sixth embodiment of the present invention.

FIG. 24 shows primary information sent from each unit to the communication information confirming unit 19. The radio communication control unit 17 sends the antenna ID, the time information indicative of the time that the antenna ID is obtained, and the ID of the moving body to the communication information confirming unit 19. The moving body detecting sensor control unit 6 sends the detection position information of the leading end of the moving body, the time information indicative of the time that the detection position information of the leading end is obtained, the detection position information of the trailing end of the moving body, and the time information indicative of the time that the detection position information of the trailing end is obtained to the communication information confirming unit 19. The radio communication control unit 7 sends the ID of the antenna, the time information indicative of the time that the ID of the antenna is obtained and the ID of the moving body to the communication information confirming unit 19.

In the sixth embodiment, when the moving body 1 is equipped with the communication apparatus, the communication of the moving body with the antenna 3 is required to be made until the trailing end of the moving body is detected by the moving body detecting sensor 2 after the leading end of the moving body is detected by the sensor 2. When a length of the moving body 1 is short, the order of the communication time and the detection time of the trailing end of the moving body is sometimes reversed. In this case, the detection information of the trailing end is delayed in the internal process of the communication information confirming unit 19 so that decision can be made exactly.

Figure 25:
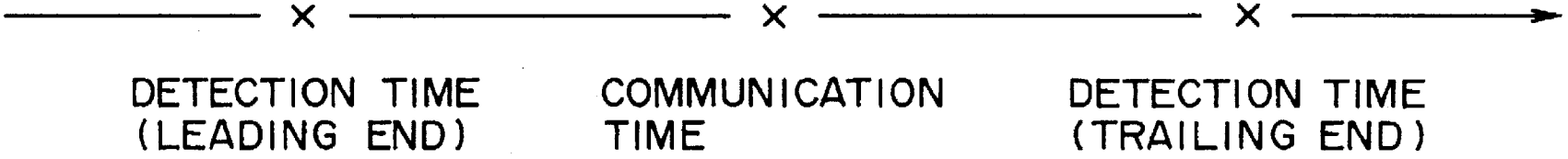
FIG. 25 is a diagram illustrating occurrence order of information obtained from the moving body 1 in the sixth embodiment.
Figure 26:
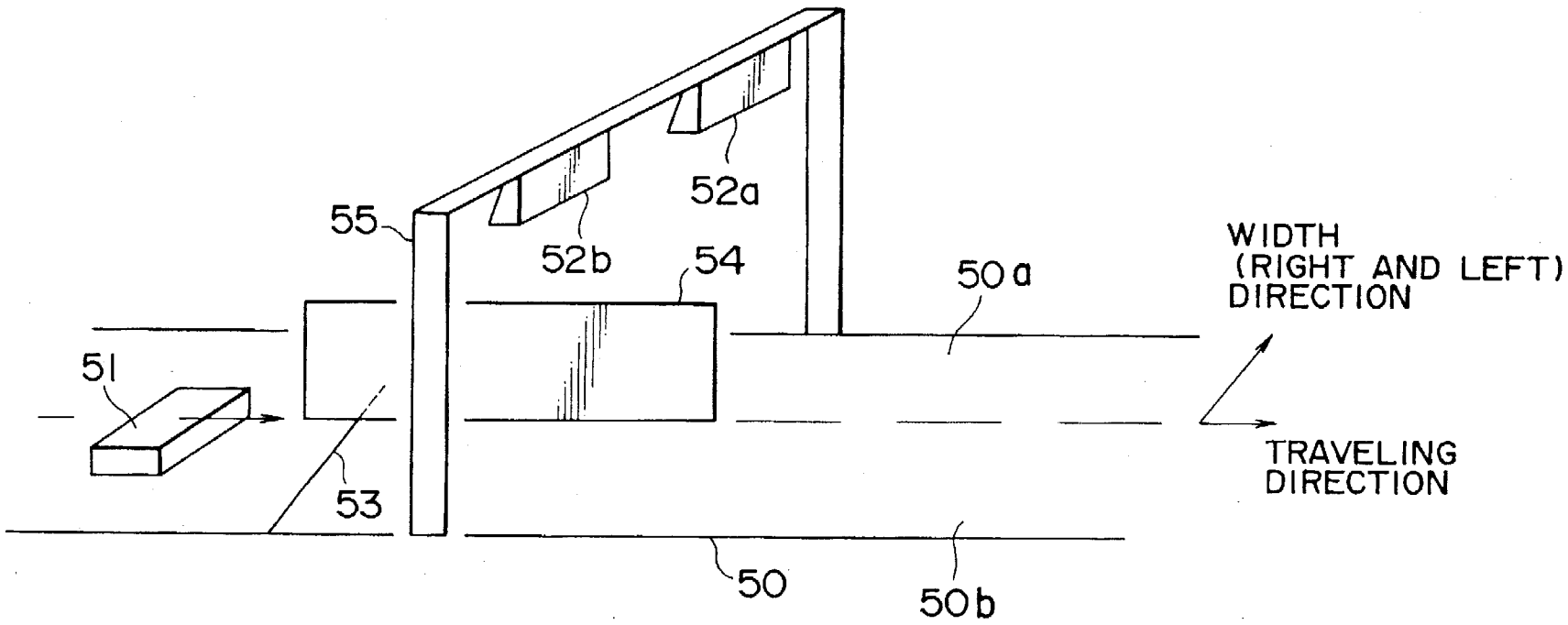
FIG. 26 is a diagram illustrating a prior art.

FIG. 25 shows the order of occurrence of information obtained from the moving body 1 in the sixth embodiment. That is, the leading end of the moving body 1 is detected by the moving body detecting sensor 2, the communication with the moving body is then made, and thereafter the trailing end of the moving body 1 is detected by the sensor 2.

The detection information Of the trailing end of the moving body sent from the moving body detecting sensor control unit 8 in the fifth embodiment is sent from the moving body detecting sensor control unit 6 in the sixth embodiment. Accordingly, in the process of the sixth embodiment, the decision as to whether the moving body 1 is equipped with the communication apparatus or not is completed earlier than the fifth embodiment.

Even in this embodiment, it is possible to add the imaging means and specify the vehicle which does not have the particular information or has the particular information to record an image of the vehicle in the same manner as the above embodiment.

As described above with reference to the embodiment, according to the present invention, whether the moving body detected by the moving body detecting means has the particular information or not can be decided without limiting the traveling position of the moving body.

Further, as described in the embodiment, the imaging means and the imaging means control unit can be combined to specify the moving body which does not have the particular information or has the particular information and record an image thereof selectively.

In the apparatus shown in the fourth to sixth embodiments, the moving body capable of moving freely is caused to hold the moving side communication means which holds the predetermined particular information to be able to transmit the particular information and when the moving body comes near or reaches a fixed position, the fixed position side communication means installed in this position communicates with the moving side communication means held in the moving body, so that the moving body detecting means detects the moving body without contact with the moving body. The decision means decides whether the moving body holds the predetermined particular information or not on the basis of the communication result with the moving body by the fixed position side communication means and the detection information of the moving body detecting means.

As described above, the fixed position side communication means having the narrow communication area communicates with the moving side communication means held in the moving body to obtain the result thereof and the information thereof is outputted. The moving body detecting means detects the moving body entering the narrow communication area of the fixed position communication means without contact with the moving body and outputs the information thereof. Accordingly, even if there is no partition for separating the moving bodies, another moving body can be distinguished. Since the partition is not required, the stability can be ensured and the movement space of the moving bodies can be utilized effectively without narrowing the movement space. Further, since the moving body can be detected without contact with the moving body, there is no limitation to an object to be detected. In addition, the moving body entering into the narrow communication area of the fixed position side communication means is detected and when there is the detection information, whether the moving body holds the particular information or not is decided on the basis of the communication result with the moving side communication means. Accordingly, the effects that whether the particular information is present or not can be detected with high accuracy and the like are obtained.

The embodiments of the present invention are not limited to the above examples and various modifications can be made. Objects to which the present invention can be applied are not also limited to the examples described in the embodiments and the present invention can be applied to various applications.

As described above, according to the present invention, there can be provided the moving body monitoring apparatus having the effects that the traveling position of the moving body is not limited upon communication and whether the moving body includes the communication means or not or whether the moving body has the particular information or not can be decided with high accuracy.

We claim:

1. A moving body monitoring apparatus for monitoring a moving body which moves freely in a monitored area, said moving body monitoring apparatus comprising:

moving side communication means adapted for placement in a moving body capable of moving freely through said monitored area;

fixed position side communication means disposed in a fixed position and having at least one antenna arranged to communicate in a narrow communication area defined within said monitored area, said fixed position side communication means being arranged to communicate with said moving side communication means when said moving side communication means is held in said moving body while passing through said narrow communication area;

moving body detecting means for detecting said moving body when entering into said narrow communication area of said at least one antenna, regardless of whether said moving body holds a moving side communication means; and a decision unit for deciding whether said moving body detected by said moving body detecting means holds a said moving side communication means or not, wherein:

said decision unit is arranged so as to receive information from said fixed position side communication means about an antenna identification number associated with said at least one antenna and a time of communication between said moving side communication means and said at least one antenna, said decision unit is further arranged so as to receive information from said moving body detecting means about a position of said moving body and time of detection, and said decision unit being further arranged so as to sort said information into a first group, if occurrences of said time of communication and time of detection coincide with a predetermined sequential order, and to sort said information into a second group if said information about a position of said moving body indicates that said moving body is within said narrow communication area and the time of communication coincides with the time of detection, wherein said decision unit determines that said moving body has one of said moving side communication means if the number of information in said first group equals the number of information in said second group, regardless of whether said monitored area is divided into separate lanes by barriers.

2. The moving body monitoring apparatus according to claim 1, wherein:

said moving side communication means comprises a radio communication apparatus;

said moving body detecting means comprises moving body detecting sensors for detecting a position of said moving body and moving body detecting sensor control units for controlling said moving body detecting sensors and for sending outputs to said decision unit;

said fixed position side communication means comprises a plurality of said at least one antenna for communicating with said radio communication apparatus and a radio communication apparatus control unit for controlling said antennas and for sending information obtained using said antennas to said decision unit.

3. A moving body monitoring apparatus for monitoring a moving body which moves freely in a monitored area, said moving body monitoring apparatus comprising:

moving side communication means adapted for placement in a moving body capable of moving freely through said monitored area, said moving side communication means having particular information;

fixed position side communication means disposed in a fixed position and having at least one antenna arranged to communicate in a narrow communication area defined within said monitored area, said fixed position side communication means being arranged to communicate with said moving side communication means when said moving side communication means is held in said moving body while passing through said narrow communication area;

moving body detecting means for detecting said moving body when entering into said narrow communication area of said at least one antenna, regardless of whether said moving body holds a moving side communication means; and a decision unit for deciding whether said moving side communication means of said moving body detected by said moving body detecting means holds said particular information or not, said decision unit being arranged so as to receive said particular information from said fixed position side communication means and classify said particular information according to whether said particular information matches data in a database of the decision unit, said decision unit being further arranged so as to receive information from said fixed position side communication means about an antenna identification number associated with said at least one antenna and about a time of communication between said moving side communication means and said at least one antenna, and to further receive information from said moving body detecting means about a position of said moving body and time of detection, said decision unit being further arranged to sort said information into a first group, if occurrences of said time of communication and time of detection coincide with a predetermined sequential order, and to sort said information into a second group if said information about a position of said moving body indicates that said moving body is within said narrow communication area and the time of communication coincides with the time of detection, wherein said decision unit determines that said moving body has one of said moving side communication means with said particular information if the number of information in said first group equals the number of information in said second group, and further the particular information received by said decision unit corresponds to said data in said database, regardless of whether said monitored area is divided into separate lanes by barriers.

4. The moving body monitoring apparatus according to claim 3, wherein:

said moving side communication means comprises a radio communication apparatus in which particular information is stored;

said moving body detecting means comprises moving body detecting sensors for detecting a position of said moving body and moving body detecting sensor control units for controlling said moving body detecting sensors and for sending information to said decision unit;

said fixed position side communication means comprises a plurality of said at least one antenna for communicating with said radio communication apparatus and a radio communication apparatus control unit for controlling said antennas and for sending information obtained using said antennas to said decision unit.

* * * * *